United States Patent [19]

Johdai et al.

[11] Patent Number: 5,013,021

[45] Date of Patent: May 7, 1991

[54] PAPER CONTAINER WITH A PAPER BINDING FUNCTION

[75] Inventors: Akiyoshi Johdai; Keichi Kinoshita; Toshio Matsui, all of Toyokawa, Japan

[73] Assignee: Minolta Camera Kabushiki Kaisha, Osaka, Japan

[21] Appl. No.: 462,905

[22] Filed: Jan. 8, 1990

Related U.S. Application Data

[63] Continuation of Ser. No. 108,899, Oct. 15, 1987, abandoned.

[30] Foreign Application Priority Data

| | | | |
|---|---|---|---|
| Oct. 16, 1986 | [JP] | Japan | 61-159109 |
| Oct. 16, 1986 | [JP] | Japan | 61-159110 |
| Oct. 17, 1986 | [JP] | Japan | 61-248188 |
| Oct. 17, 1986 | [JP] | Japan | 61-248189 |
| Oct. 17, 1986 | [JP] | Japan | 61-248190 |
| Oct. 17, 1986 | [JP] | Japan | 61-248191 |
| Oct. 21, 1986 | [JP] | Japan | 61-251362 |

[51] Int. Cl.[5] ..... B42B 2/00

[52] U.S. Cl. ..... 270/53; 270/58; 271/3.1; 271/220; 271/221

[58] Field of Search ..... 270/37, 53, 58, 52; 271/3.1, 279, 207, 220, 221, 251, 184, 236, 242

[56] References Cited

U.S. PATENT DOCUMENTS

| | | | |
|---|---|---|---|
| 3,386,729 | 6/1968 | Pine . | |
| 3,645,615 | 2/1972 | Spear . | |
| 3,697,063 | 10/1972 | Greenfield et al. | 271/4 |
| 3,709,595 | 1/1973 | Turner et al. | 355/14 |
| 3,944,207 | 3/1976 | Bains | 270/58 |
| 4,067,649 | 1/1978 | Hubbard et al. . | |
| 4,073,391 | 2/1978 | O'Brien et al. | 270/58 |
| 4,076,408 | 2/1978 | Reid et al. | 355/14 |
| 4,123,155 | 10/1978 | Hubert . | |
| 4,134,672 | 1/1979 | Burlew | 270/58 |
| 4,145,037 | 3/1979 | Mol | 270/58 |
| 4,190,246 | 2/1980 | Sasuga . | |
| 4,203,587 | 5/1980 | Kishi et al. . | |
| 4,218,128 | 8/1980 | Satomi et al. . | |
| 4,227,275 | 10/1980 | Söderberg | 11/1 |
| 4,238,066 | 12/1980 | Brooke | 270/53 |
| 4,248,413 | 2/1981 | Fox | 270/53 |
| 4,248,525 | 2/1981 | Sterrett | 270/58 X |
| 4,265,440 | 5/1981 | Shibazaki et al. . | |
| 4,272,180 | 6/1981 | Satomi et al. . | |
| 4,281,920 | 8/1981 | Cross | 355/75 |
| 4,295,733 | 10/1981 | Janssen et al. | 355/14 SH |
| 4,313,670 | 2/1982 | Caldwell | 355/3 |
| 4,361,393 | 11/1982 | Noto | 355/35 H |
| 4,365,886 | 12/1982 | Murakami et al. | 355/3 SH |
| 4,368,972 | 1/1983 | Naramore | 355/14 SH |
| 4,371,155 | 2/1983 | Asterö et al. | 270/53 |

(List continued on next page.)

OTHER PUBLICATIONS

Xerox Disclosure Journal, vol. 2, No. 5, Sep./Oct. 1977.

IBM Technical Disclosure Bulletin, vol. 18, No. 9, *Stapler Unloader for Copier,* Galle et al, 2/76.

*Primary Examiner*—Edward K. Look

*Assistant Examiner*—Therese M. Newholm

*Attorney, Agent, or Firm*—Burns, Doane, Swecker & Mathis

[57] ABSTRACT

A paper container has a finisher unit which comprises transporting rollers to transport copying papers ejected from a copying machine to a tray, a paddle wheel to transport a copying paper to a reference member for alignment immediately after a trailing edge of the copying paper leaves the transporting rollers, and a stapler to staple the copying papers aligned on the tray. The paper container also has a stack unit to stack the stapled papers. The stack unit is permanently secured onto the image forming device, or an distance between the stack unit and the finisher unit is arbitrarily adjusted, while the finisher unit is attached to the image forming device and detached if so required.

17 Claims, 23 Drawing Sheets

U.S. PATENT DOCUMENTS

| | | | |
|---|---|---|---|
| 4,376,529 | 3/1983 | George | 270/53 |
| 4,385,827 | 5/1983 | Naramore | 355/14 SH |
| 4,411,515 | 10/1983 | Kukucka et al. | 355/14 |
| 4,424,963 | 1/1984 | Bartholet et al. | 270/53 |
| 4,473,425 | 9/1984 | Baughman et al. | 156/356 |
| 4,497,478 | 2/1985 | Reschenhofer et al. | 270/53 |
| 4,515,458 | 5/1985 | Masuda et al. . | |
| 4,549,804 | 11/1985 | Braun et al. | 270/53 X |
| 4,564,185 | 1/1986 | Hamlin et al. | 270/53 |
| 4,566,782 | 1/1986 | Britt et al. | 355/14 |
| 4,573,789 | 3/1986 | Wada . | |
| 4,582,421 | 4/1986 | Hamlin et al. | 355/72 |
| 4,592,651 | 6/1986 | Oikawa et al. . | |
| 4,595,187 | 6/1986 | Bober . | |
| 4,603,971 | 8/1986 | Kukucka | 270/53 |
| 4,626,156 | 12/1986 | Baughman et al. | 412/33 |
| 4,647,034 | 3/1987 | Sawa | 271/293 |
| 4,647,188 | 3/1987 | Komiya et al. . | |
| 4,674,732 | 6/1987 | Hori | 270/53 |
| 4,674,866 | 6/1987 | Tanaka | 355/23 |
| 4,687,191 | 8/1987 | Stemmle | 270/53 |
| 4,702,589 | 10/1987 | Ito . | |
| 4,718,657 | 1/1988 | Otter et al. | 271/184 |
| 4,721,382 | 1/1988 | Ito et al. . | |
| 4,730,206 | 3/1988 | Sawada et al. . | |
| 4,743,945 | 5/1988 | Ito et al. | 355/14 SH |
| 4,763,889 | 8/1988 | Dei et al. . | |
| 4,795,071 | 1/1989 | Jacobs et al. . | |

FOREIGN PATENT DOCUMENTS

| | | | |
|---|---|---|---|
| 99250 | 1/1984 | European Pat. Off. . | |
| 2732673 | 9/1978 | Fed. Rep. of Germany | 270/53 |
| 3218747 | 12/1982 | Fed. Rep. of Germany . | |
| 3701450 | 3/1984 | Fed. Rep. of Germany . | |
| 55-15150 | 2/1980 | Japan . | |
| 57-72537 | 5/1982 | Japan . | |
| 57-131667 | 8/1982 | Japan . | |
| 57-203037 | 8/1982 | Japan . | |
| 59-43765 | 3/1984 | Japan . | |
| 59-177232 | 7/1984 | Japan . | |
| 60-183461 | 9/1985 | Japan . | |
| 60-248563 | 12/1985 | Japan . | |
| 61-72569 | 4/1986 | Japan . | |
| 61-26061 | 6/1986 | Japan . | |
| 61-145069 | 7/1986 | Japan . | |
| 61-261096 | 11/1986 | Japan . | |
| 2185465 | 7/1987 | United Kingdom . | |

PAPER CONTAINER WITH A PAPER BINDING FUNCTION

This application is a continuation of application Ser. No. 108,899, filed Oct. 15, 1987 now abandoned.

BACKGROUND OF THE INVENTION

1. Field of the Invention

The present invention relates to a paper container, in particular, a paper container which has a function to bind the copying papers ejected from a copying machine and stored on the tray.

2. Description of the Prior Art

As for conventional paper containers with a paper binding function which are installed on a copying machine, such devices are well known as those disclosed in U.S. Pat. Nos. 4,248,525, 4,549,804 and 3,944,207, and in Japanese patent Laid Open Publications No. 60-248563 and No. 57-72537, and in European Patent Publication No. 99250. Among these devices, the similar paper container, usually known as a finisher, has an arrangement where the copying paper undergone copying operation are stored and aligned on a tray or the like, then stapled and transferred onto a stack unit, thereby stacked and stored.

Then, some of such containers, for example, one disclosed in said European Patent Publication No. 99250 has a vane wheel-shaped paddle wheel which rotates in one specific direction in order to align a copying paper transported on a tray. In this method, however, the copying papers transported onto the tray by a transport roller readily skew, making accurate alignment difficult, because those papers are allowed to slide downward freely and reach the paddle wheel. Moreover, to accurately staple copying papers with a stapling means, the interval between supporting members on a tray requires accurate adjustment. At the same time, if a tray with a sheet aligning function is disposed in the substantially vertical direction, it is required to hold the copying papers stored on the tray while guiding the copying papers so as to prevent paper jamming.

Additionally, since any of the above mentioned paper containers is secured to a copying machine, a larger large space is required to remove jammed papers, thus resulting in a disadvantageously large apparatus. Further, such a paper container comprises an upper unit for the stapling operation and a lower stack unit which are both integrally constituted. Accordingly, there is a problem; when the upper unit is detached from the copying machine, the stack unit is at the same time detached, thereby the inertial force causes the misalignment of copying papers already having been stacked on the stack unit, and the papers to be stacked afterwards are inevitably out of alignment. Additionally, such a stack unit is designed for a user who requires a large amount of copying. Accordingly, under present circumstances, a user who only needs a small amount of copying have to use an expensive apparatus with an unnecessary powerful functions.

When the upper unit and the stack unit are independent with each other, and if either of such unit is later optionally incorporated into a copying machine, there are usually two constitutions available, as described below. First, the upper unit and the stack unit in the bottom are secured with each other, thereby the stack unit is provided with casters on the bottom surface thereof and positioned on a solid base plate. The height of base plate is designed to be adjustable. However, this arrangement causes the following problems. Since the base plate receives the load of both the upper unit and the stack unit, the height adjustment of the base plate is not necessarily each, while such a base plate incurs an increased cost. Additionally, once the adjustment has completed, it is impossible to cope with the changes in floor conditions, for example, partially depressed carpet due to the load of copying machine. In the second arrangement, the upper unit and the stack unit are completely separated and individually connected to the copying machine side. However, this arrangement also causes a problem; when another optional unit such as a sorter, paper re-feeding unit or the like is incorporated into between the copying machine and the upper unit, the stack unit hinders the incorporation.

SUMMARY OF THE INVENTION

Therefore, one object of the present invention is to provide a paper container which can accurately receive and align, onto a tray, copying papers ejected from an image forming means without causing skewing.

Another object of the present invention is to provide a paper container having a compact electric stapler which involves a shorter head stroke and requires a smaller motive force.

Still another object of the present invention is to provide a paper container which reliably ejects copying papers from a stapling tray onto a stack unit without using a paper ejection means provided exclusively for this purpose, whereby such a paper container may be of a greatly simplified structure.

Still another object of the present invention is to provide a paper container which correctly guides a copying paper onto a tray disposed in a substantially vertical status, without causing paper jamming.

Still another object of the present invention is to provide a paper container, which does not require a specific arrangement to provide a space to cope with paper jamming or the like for an upper unit having a paper stapling function, and with which, even when the upper unit is detached from the image forming means, a stack unit positioned under the upper unit does not simultaneously move, therefore the alignment of copying papers already stacked on the stack unit is not disturbed. At the same time, with such a paper container, a user is allowed to select one specific stack unit, for maximum operation efficiency, among those having various capacities, in order to use it combinedly with the upper unit.

The other object of the present invention is to provide a paper container, with which the upper unit and the stack unit are independently held, while the total load is properly distributed, in order to allow easy height adjustment, whereby a height holding mechanism is simplified and both units may be readily shifted with a smaller force when the mechanism is released.

To attain the above objects, a paper container according to the present invention comprises a copying paper containing tray having a reference member for defining a reference point of paper alignment, the reference member provided at one specific corner of the tray, first means for transporting the copying paper to the tray and second means for transporting the copying paper to the reference member immediately after the trailing edge of the copying paper leaves the first transporting means. The tray comprises a paper containing chamber having a first support member and a second support member, and storing the copying papers transported between both members. Wherein the distance between the first support member and the second support member in the second transporting means side is larger than that in a stapling means side. The second transporting means also serves to transport the copying papers stapled by the stapling means to a stacking means.

Additionally, the tray for storing the copying paper is designed in the substantially vertical status. A felxible member extends from the upstream side of the first transporting means to the upper portion of the copying papers stored in the tray.

The paper container according to the present invention comprises a first unit arbitrarily detachable from an image forming means and a second unit secured onto the image forming means.

BRIEF DESCRIPTION OF THE DRAWINGS

These and other objects and features of the present invention will become apparent from the following description taken in conjunction with the preferred embodiments thereof with reference to the accompanying drawings, in which:

FIG. 1 through FIG. 16 whow an embodiment of the present invention;

FIG. 1 is an internal composition of a paper container;

FIG. 2 is a side elevational view taken in the direction of the arrow E in FIG. 1;

FIG. 3 is a perspective view of the pressing member;

FIG. 4 and FIG. 5 are explanatory drawings showing paper transporting into the stapling tray;

FIG. 6 is a schematic block diagram showing a paper container with a stack unit;

FIG. 7 is a schematic block diagram showing a copying machine and a paper container;

FIG. 8 is a plan view showing an opeation panel of the paper container;

FIG. 9 is a diagram showing a control circuit;

FIG. 10 is a flow chart showing a main routine of the first CPU;

FIG. 11 is a flow chart showing a subroutine for signal processing;

FIG. 12 is a flow chart showing a main routine of the second CPU;

FIG. 13 is a flow chart showing a subroutine for canceling a stapling mode;

FIG. 14 is a flow chart showing a subroutine for mode setting;

FIG. 16 is a flow chart showing a subroutine for paper stapling/stacking;

FIG. 28 is a schematic block diagram showing a copying machine and a paper container with a stack unit that remains stationary when the upper unit is detached.

FIG. 29 is a schematic block diagram showing a paper container with a stack unit secured to the image forming means.

DETAILED DESCRIPTION OF THE INVENTION

Figure 1:
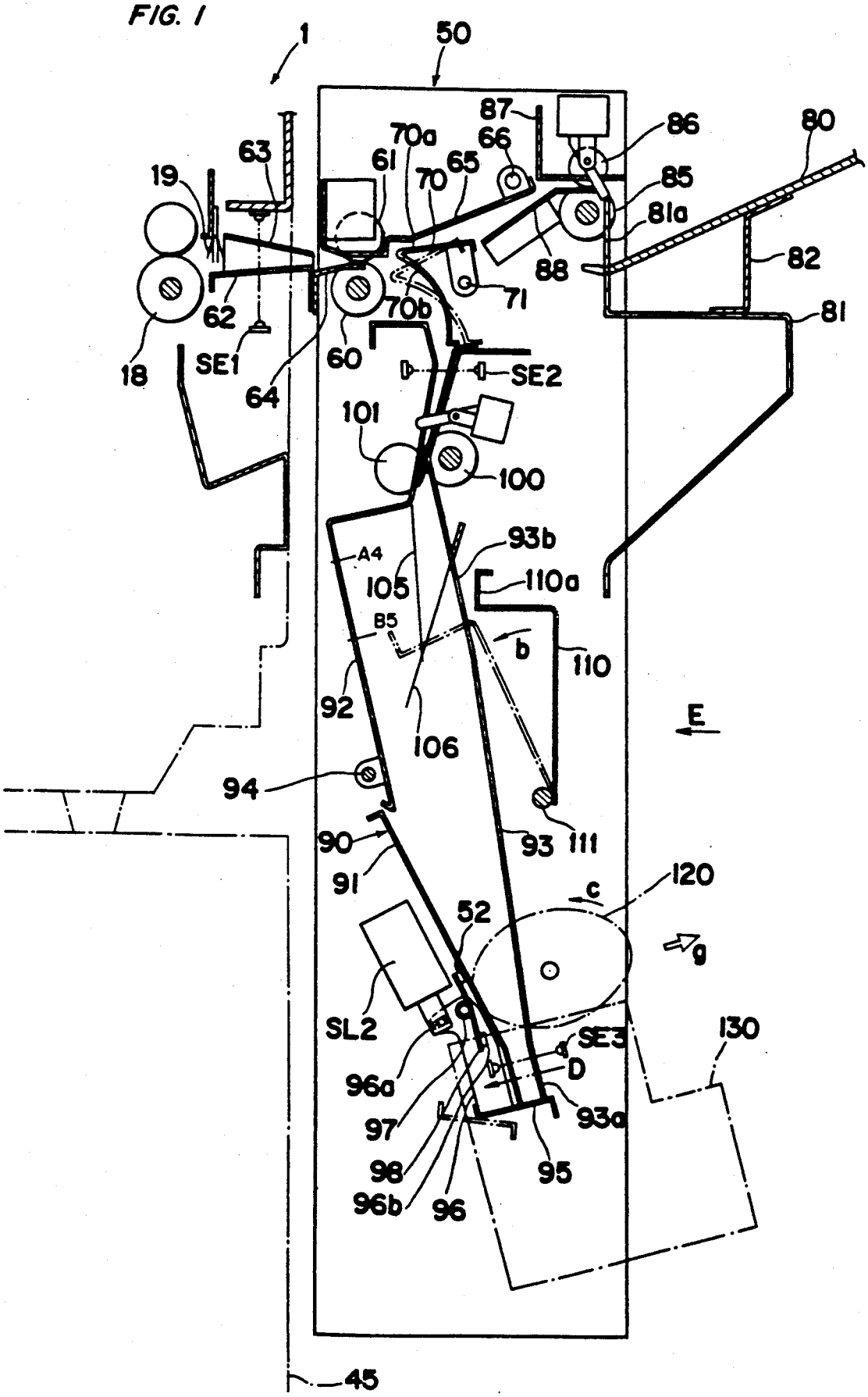

The embodiment of a paper container according to the invention is described, below, by referring to the accompanying drawings General constitution including copying machine and ADF First, the general constitution of a copying machine 1 is described, by referring to FIG. 7.

A copying machine 1 is placed on a desk 45, and an automatic document feeder 30 with a document circulating function, which is hereinafter referred to as ADF is disposed on the top surface thereof. Inside the copying machine 1, there is a photosensitive drum 2 rotatable in the arrow (a) direction. Around the drum 2, such well known image forming elements are arranged as an optical system 3, an electrifying charger 4, a developing device 5, a transfer charger 6, a cleaning device 7, an eraser lamp 8 and others. These elements and the copying processes of the elements are so well known that the detailed description of them is omitted.

Copying papers which are loaded in an automatic paper feeder cassette 10 or 11, are fed sheet by sheet from a specific cassette selected from the cassettes 10 and 11. Then, by a pair of timing rollers 15, a copying paper is synchronized with a toner image formed on the circumferential surface of the photosensitive drum 2 and is transported to a transfer portion 2*a*. After the transfer processing, the copying paper is supplied to a fixing device 17, by a conveyor belt 16, where toner image is fixed, then the paper is ejected by a pair of ejection rollers 18.

The ADF 30 generally comprises a document deck tray 31, a document feeder belt 32, a pair of document feeder rollers 33, a diverting guide plate 34, a transport belt 35, a diverting roller 36 and a pair of ejection rollers 37. The ADF 30 transports one set of documents sheet by sheet from the last page. One set of documents are placed on the tray 31, with the reverse side of the last page positioned downward, and drawn out sheet by sheet from the last page by the travel of the feeder belt 32. Then, the document is fed to between the transport belt 35 and a document deck glass 9, via the pair of document feeder rollers 33 as well as the diverting guide plate 34. Next, the document is set at the specified position on the document deck glass 9 by the travel of the transport belt 35 to be subjected to one sequence of irradiation with the optical system 3. After the imagewise exposure, the document is transported by the transport belt 35 from the document deck glass 9 toward the right side in FIG. 7, where diverted by the diverting roller 36, then ejected by the pair of ejection rollers 37 onto the stack of other documents placed on the tray 31, with the surface having an image is upward.

Incidentally, one sequence of imagewise exposure is defined as one cycle of copying operation. The ADF 30 repeats one cycle of copying operation up to the number of cycles which has been entered with unshown ten numerical keys. Additionally, the number of documents to be duplicated in one cycle of copying operation is also entered with the similar keys. Further, the ADF 30 is disposed to be freely lifted from and lowered onto the copying machine 1. Therefore, with the ADF in the lifted position, a document can be manually set, for a copying operation, on the document deck glass 9. The ADF 30 does not operate when lifted. Lifting the ADF 30 is detected by an unshown switch located in the vicinity of the document deck glass 9.

With a paper container in this embodiment of the invention, copying papers ejected from the copying machine 1 are selectively received either by an ejection tray 80 or by a stapling tray 90, where aligned, then stapled with a stapler 130. Accordingly, once a plural set of copying papers are duplicated in used the ADF and to stapling operation, these sets of copying papers are sequentially stored on the stapling tray 90. Then, when one cycle of copying operation has completed, the stapler 130 is actuated based on a stapling signal outputted from the copying machine 1, in order to staple one set of copying papers. The one set of copying papers stapled is stacked in a stack box 161.

Constitution of finisher unit

The constitution of a finisher unit 50 is hereinafter described by referring to FIGS. 1, 2 and 3.

The finisher unit 50 generally comprises rollers 60 and 61 for receiving a copying paper, a diverting member 70 for diverting a transport course, a paper ejection tray 80, paper ejection rollers 85 and 86 for ejecting a copying paper onto the ejection tray 80, a stapling tray 90, paper transport rollers 100 and 101 for transporting a copying paper to the stapling tray 90, a pressing member 110 capable of pressing the upper portion of papers stored in the stapling tray 90, a paddle wheel 120 for aligning a copying paper stored in the stapling tray 90 relative to the corner (A) and a stapler 130.

A portion to receive a copying paper comprises, in addition to the above mentioned rollers 60 and 61, guide plates 62 and 63 laterally opposing to the pair of ejection rollers 18, and a guide plate 64 provided within the unit 50. A guide plate 65 extends from the receiving portion to the ejection rollers 85 and 86. The guide plate 65 can be lifted upwards on a pivot 66, so as to enable various procedures such as the removable of jammed papers. The roller 61 is mounted on the guide plate 65.

Incidentally, an ejection portion of the copying machine 1 has a neutralizing brush 19, and a photosensor SE1 which detects a copying paper.

As shown in FIG. 1, a bill-shaped diverting member 70 is pivotally attached to a pivot 71, thereby turning ON an unshown solenoid shifts the member 70 from a position shown by the dashed line to a position shown by the solid line. At the position of the short dashed line, the diverting member 70 leads a copying paper to the paper ejection tray 80 side along the top surface **70*a* of the member 70. At the position of the solid line, the diverting member 70 leads a copying paper to the stapling tray 90 side along the inwardly curved surface 70*b***.

The paper ejection tray 80 is secured on the exterior of the unit 50 through support plates 81 and 82. The bottom end of the paper ejection tray 80 is located below the ejection rollers 85 and 86 and intersects with a stopper **81*a* to stop the trailing edge a copying paper. Near the ejection rollers 85 and 86, guide plates 87 and 88 are disposed, while the ejection roller 86 is attached to the guide plate 87**.

The stapling tray 90 comprises a main base plate 91, a guide plate 92, and a guide plate 93 facing both the main base plate 91 and the guide plate 92, and a stopper 95. The stapling tray 90 is disposed upright, slightly leaning toward the left. The upper portion of the guide plate 92 extends toward the vicinity of the inwardly curved surface **70*b* of the diverting member 70 and can be pivotally opened up counterclockwise on a pivot 94 in FIG. 1 so as to allow procedures such as the removal of jammed paper. The upper portion of the guide plate 93 opposes the upper portion of the guide plate 92 via a narrow space, and extends toward directly below the diverting member 70. To the lower portion of the guide plate 93, the area 93*a* faces the base plate 91 at the position lower than that of a paddle wheel 120 mentioned later, with the narrower space compared with other areas. More specifically, the space between the area 93*a* and the base plate 91 is slightly larger than the thickness of a specified number of copying papers which can be stored in the stapling tray 90. The reason for why the thickness in an area corresponding with the paddle wheel 120** is narrower and the thicknesses in the other areas are larger is that it is intended to minimize the friction exerted between the already stored and aligned copying papers and the currently aligned paper in order to ensure that all the copying papers aligned to the alignment reference line (A') to (A').

Additionally, the area **93*a* is provided with a photosensor SE3 for detecting a copying paper transported into the stapling tray 90**.

The stopper 95 forms the bottom plate of the stapling tray 90, and is rotatably attached to a pivot 97 through an arm 96. The arm 96 is connected with a solenoid SL2 via a pin **96*a*, thereby both ends of a torsion spring 98, coiled around the pivot 97, is engaged respectively with a projection 96*b* on the arm 96 and a projection 52 on the frame 5. Therefore, as shown in FIG. 1, when the solenoid SL2 is in the OFF status, the stopper 95 is in a shown by the solid line in FIG. 1 and closes the bottom of the stapling tray 90. On the other hand, once the solenoid SL2 is turned ON, the stopper 95 pivotally moves on the pivot 97 to a position shown by the dashed line to open the bottom of the stapling tray 90**.

The transport rollers 100 and 101 are disposed at the area where the space between the upper portions of the above mentioned guide plates 92 and 93 is the narrowest. The transport rollers 100 and 101 transport a copying paper guided downwards along the inward curved side **70*b* of the diverting member 70. A photosensor SE2 for detecting a copying paper is disposed immediately above the similar rollers 100 and 101**.

Strip-shaped flexible sheets 105 are attached to the upper portion of the plate 92. The flexible sheets 105 hang down in the stapling tray 90, through the side of the nip portion between the rollers 100 and 101. The bottom end of the flexible sheets 105 extends to the position slightly lower than that of the upper edge of a minimum size B5 paper as stored in the stapling tray 90, and reaches a neutralizing brush 106 attached to the guide plate 93. The flexible sheets 105, while a copying paper is transported to the stapling tray 90, provides the copying paper with a stiffness proportional to the thickness of the paper in order to ensure the paper to be correctly transported into the stapling tray 90. Further, the flexible sheets 105 together with the neutralizing brush 106 touch and support the upper portion of the stored copying papers in order to prevent the copying paper from leaning toward the guide plate 93 or collapsing.

Additionally, the nip portion between the above mentioned transport rollers 100 and 101 is arranged so that a copying paper nipped may face the guide plate 93 side. This arrangement is provided in order to reduce contact friction between a copying paper being transported into the stapling tray 90 and copying papers already stored in the tray 90.

Figure 3:
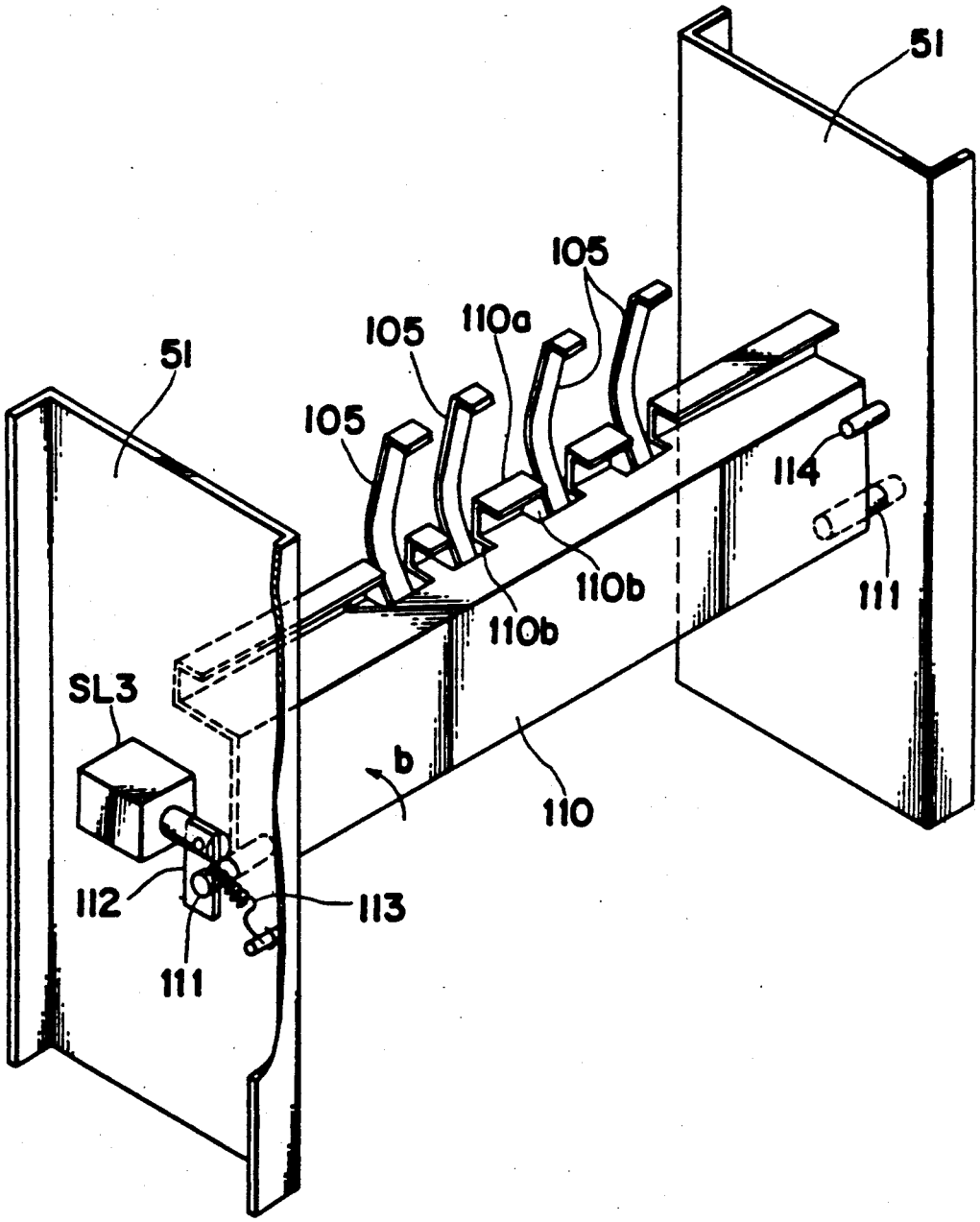

As shown in FIG. 3, the pressing member 110 is secured to two pivots 111 and 111 which are rotatably attached to frames 51 and 51. One pivot 111 is connected to a solenoid SL3 via an arm 112, and the arm 112 is drawn by a coil spring 113 in the direction reverse to an arrow (b). Therefore, when the solenoid SL3 is in the OFF status, the pressing member 110 is attracted by the drawing force of the coil spring 113 in the direction reverse to an arrow (b), and waits for another operation outside the guide plate 93, as shown by the solid line in FIG. 1, where the pressing member 110 touches a stopper pin 114. On the other hand, when the solenoid SL3 is turned ON, the pressing member 110 pivotally rotates on the pivots 111 and 111 in the direction of an arrow (b), and a head 110*a* of the similar member 110 is protruded through an opening 93*b* on the guide plate 93 into the stapling tray 90 in order to press the upper portion of copying papers stored in the stapling tray 90. Additionally, the head 110*a* is provided with notches 110*b* so as to prevent interference with the above mentioned flexible sheets 105 and neutralizing brush 106.

The paddle wheel 120 whose top is equipped with a plurality of radially-arranged blade elements is disposed at an angle of $\theta$ to the transporting direction on the surface for a copying paper. The axle 121 of the paddle wheel 120 is rotatably attached to a bracket 122 secured to the exterior of the guide plate 93. A part of the paddle wheel 120 protrudes through a long hole 93*c* formed on the guide plate 93 into the stapling tray 90. A motor M2 being rotatable in forward and reverse directions is connected with a gear 123 through an unshown reducing means. The gear 123 meshes with another gear 124 fixed to the axle 121, accordingly the paddle wheel 120 is rotatable in forward and reverse directions.

More specifically, the paddle wheel 120 rotating in the arrow (c) direction shifts a copying paper, which has been transported into the stapling tray 90, toward the corner (A) where the reference lines (A') and (A') intersect with each other. In this case, the peripheral velocity (V) of the paddle wheel 120 is predetermined so that the vertical component Vy is larger than the peripheral velocity of the transport roller 100. However, the transporting force of the paddle wheel 120 is predetermined so as to be weaker than that of the transport rollers 100 and 101. Therefore, the transporting force of the paddle wheel 120 exerted on a copying paper and derived from the rotation in the direction of an arrow (c) works after the trailing edge of the paper has passed the nip portion between the rollers 100 and 101. The position of the copying paper which has passed the rollers 100 and 101 is indicated by A4 or B5 in FIG. 2. Additionally, the copying paper is transported based on the center line (CL) as a reference line.

Figure 2:
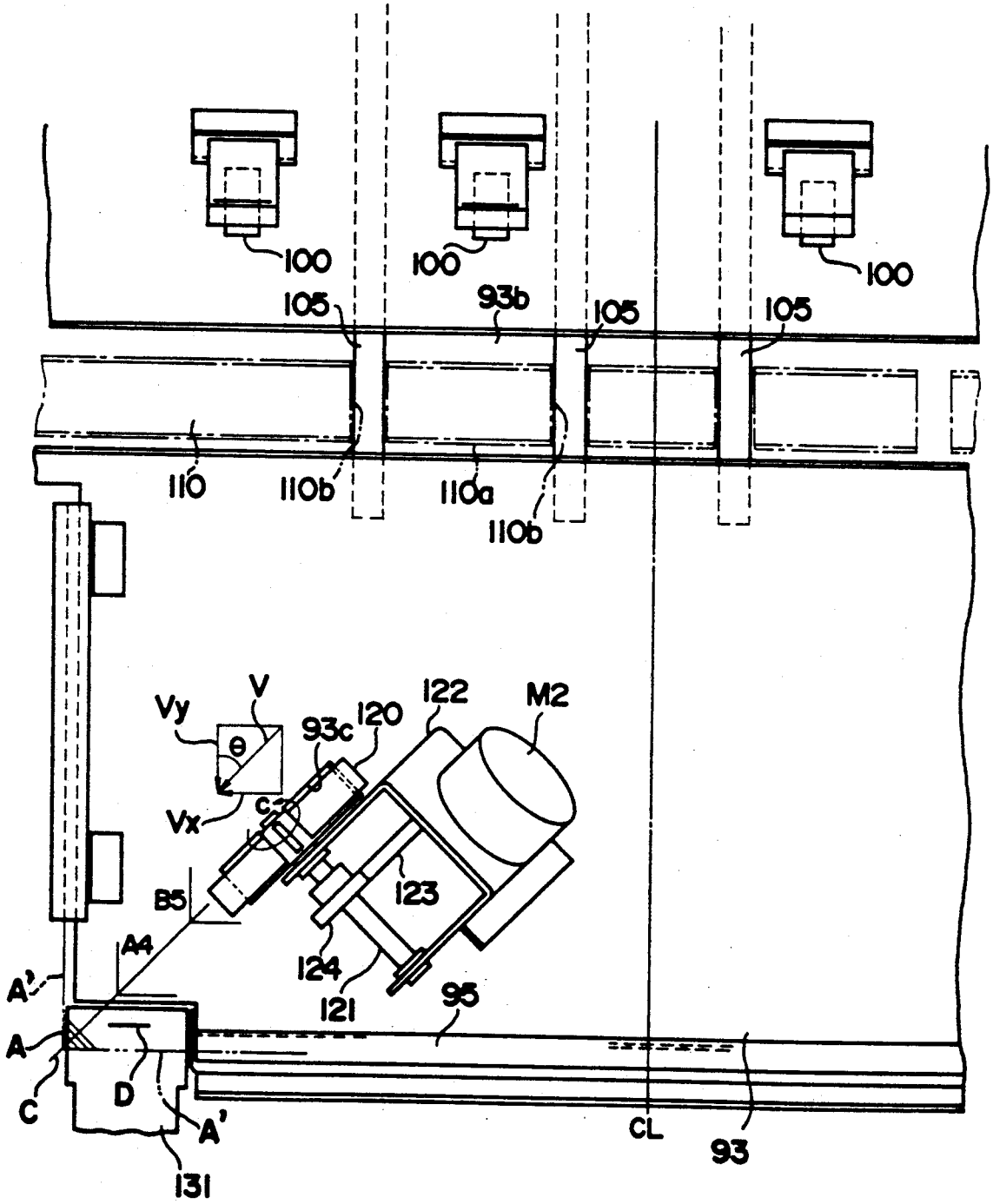

The inclination $\theta$ of the paddle wheel 120 is predetermined so that the trailing edge of a copying paper, when it has passed the transport rollers 100 and 101 and the transporting force of the paddle wheel 120 starts exerting on the paper, is substantially parallel with a straight line connecting the corner of a copying paper and the corner portion (A) in FIG. 2. This arrangement allows a copying paper to move directly to the alignment corner (A) by the rotation of the paddle wheel 120 via the shortest distance. Therefore, the alignment corner (A) should preferably be on a line (C) extending from the above corner of a copying paper and meeting the vertical line at an angle $\theta$. However, when the angle $\theta$ is smaller than 45 degrees, the corner (A) may be located below the extending line (C). When the angle $\theta$ is more than 45 degrees, the corner (A) may be above the similar line (C). Additionally, The positional relation in the vertical direction between the paddle wheel 120 and the pair of rollers 100 and 101 must be arranged so that a copying paper is subjected to the transporting force of either the paddle wheel 120 or the pair of feeder rollers 100 and 101

The stapler 130 is a well-known electric type, wherein as shown in FIG. 2 a receiver 131 is disposed on the plane common to the base plate 91 of the stapling tray 90 to staple one set of copying papers stored and aligned in the stapling tray 90.

Operation of the finisher unit

The operation of the finisher unit 50 is described, below.

Non-stapling mode

The non-stapling mode is an operation mode to stack and store copying papers, which have been ejected from the pair of ejection rollers 18 on the copying machine 1, onto the paper ejection tray 80, without a stapling operation.

In this mode, the diverting member 70 is at the position shown by the dashed line in FIG. 1, thereby a copying paper received by the rollers 60 and 61 is guided both by the top side 70*a* of the diverting member 70 and by the guide plate 65, then is ejected by the paper ejection rollers 85 and 86 onto the paper ejection tray 80.

Stapling mode

Figure 6:
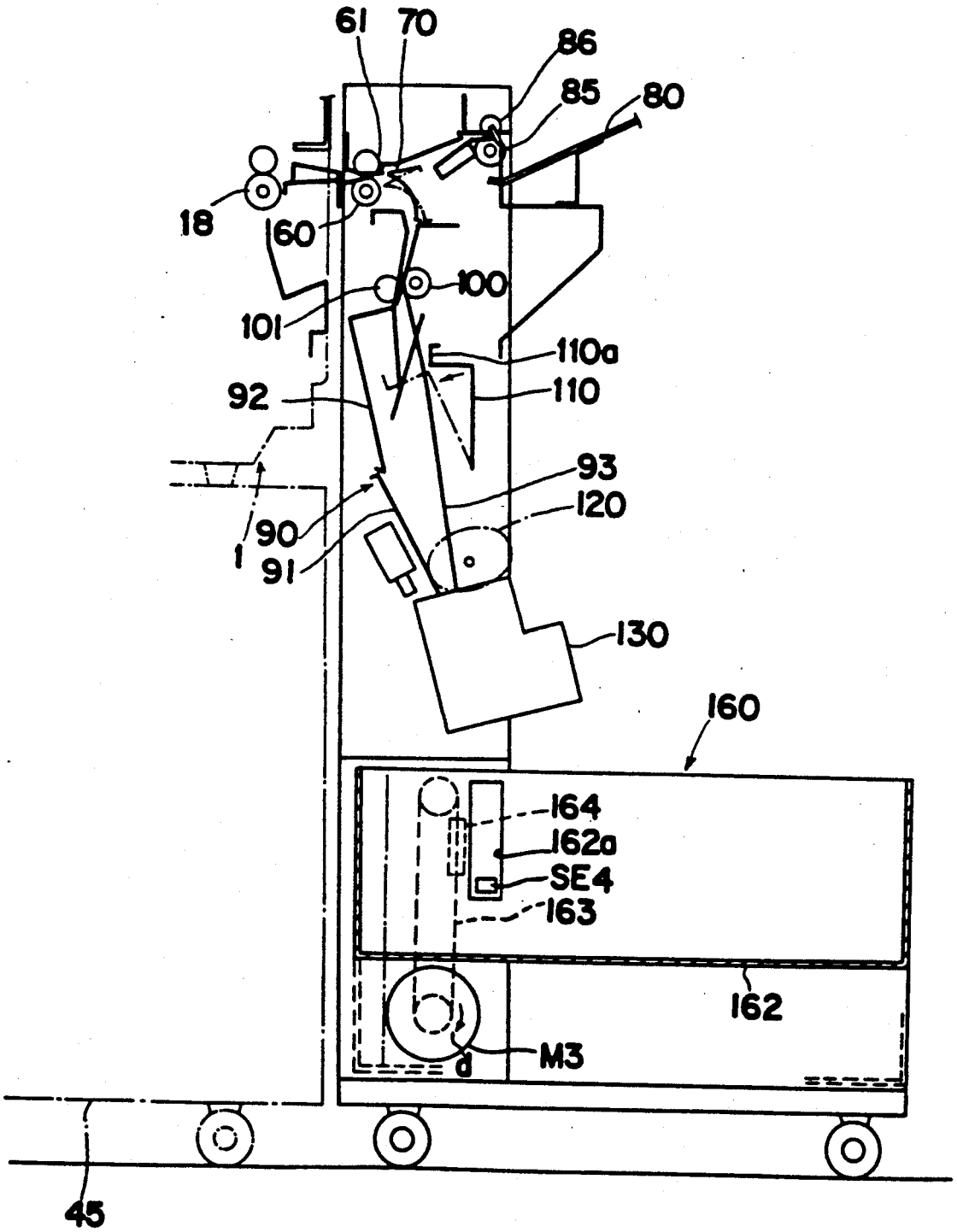

This mode is an operation mode where copying papers are stored and aligned in the stapling tray 90 and are stapled with the stapler 130, then are stacked in a stack box 161 (see FIG. 7) or in a stack unit 160 (see FIG. 6).

In this mode, the diverting member 70 is shifted to the position shown by the solid line in FIG. 1, thereby a copying paper introduced by the rollers 60 and 61 is guided both by the inwardly curved side 70*b* of the diverting member 70 and by the upper portions of the guide plates 92 and 93, and is transported by the rollers 100 and 101 in the stapling tray 90. Syncronously with the rotation of the transport rollers 100 and 101, the paddle wheel 120 is actuated to rotate forward in the direction of an arrow (c), thereby the copying paper whose trailing edge has left the rollers 100 and 101 receives the transporting force by the rotation of the paddle wheel 120 and moves toward the corner (A), where aligned. During this course, the copying paper receives the transporting force at the nip portion so as to face the guide plate 93 side based on the predetermined direction of the nip portion. At the same time, the copying paper is provided with stiffness proportional to the thickness as the flexible sheets 105 rubs the paper to minimize the friction with already stored copying papers, and consequently, the copying papers are stored in the staple tray 90 sheet by sheet. At the same time, the copying paper touches the neutralizing brush 106 and is electrically neutralized. Additionally, the tips of the flexible sheets 105 and neutralizing brush 106 touch the upper portion of copying papers already stored in the stapling tray 90 in order to prevent the papers from leaning or collapsing.

Incidentally, when a copying paper is stored as it has been curled due to the heating of the fixing unit 17 and if the upper portion of the paper is warped toward the guide plate 93, the next transported paper interferes with the upper portion of the curled paper already stored, thereby causing paper jamming. In order to prevent this trouble, the embodiment provide an arrangement, wherein the pressing member 110 presses the upper portion of the already stored copying papers.

Figure 4:
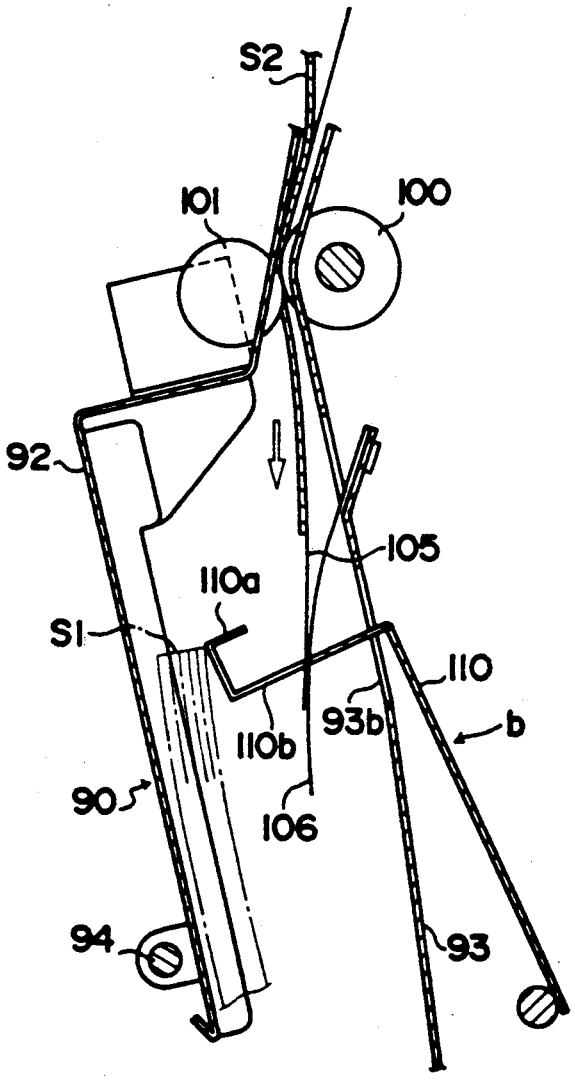

More specifically, when a specified period has elapsed since the leading edge of a copying paper is detected by the photosensor SE2, for example, at the timing when the paper is aligned in the corner (A) by the rotation of the paddle wheel 120, the solenoid SE2 is turned ON, thereby the pressing member 110 pivotally moves on the pivots 111 in the direction of an arrow (b), and the head 110*a* protrudes into the stapling tray 90 through the opening 93*b* on the guide plate 93 so as to press the upper portion of the papers S1 already stored (see FIG. 4). Consequently, the upper portion of the curled papers S1 is pressed toward the bottom of the stapling tray 90, that is, toward the guide plate 92, in order to correct the curl of the copying papers (S1).

Further, since the solenoid SL3 is turned OFF at least immediately before the leading edge of the next paper S2 reaches the vicinity of the pressing member 110, the pressing member 110 pivotally moves in the direction reverse to an arrow (b) so as to cancel the pressing force on the stored papers S1.

The above mentioned operation corrects the curled upper portion, of the copying papers S1 already stored in the stapling tray 90, which faces the guide plate 93 side, and successfully prevents the jammed papers which may be caused by the interference between the copying paper S2 next transferred to the stapling tray 90 and the already stored and curled papers S1.

Figure 5:
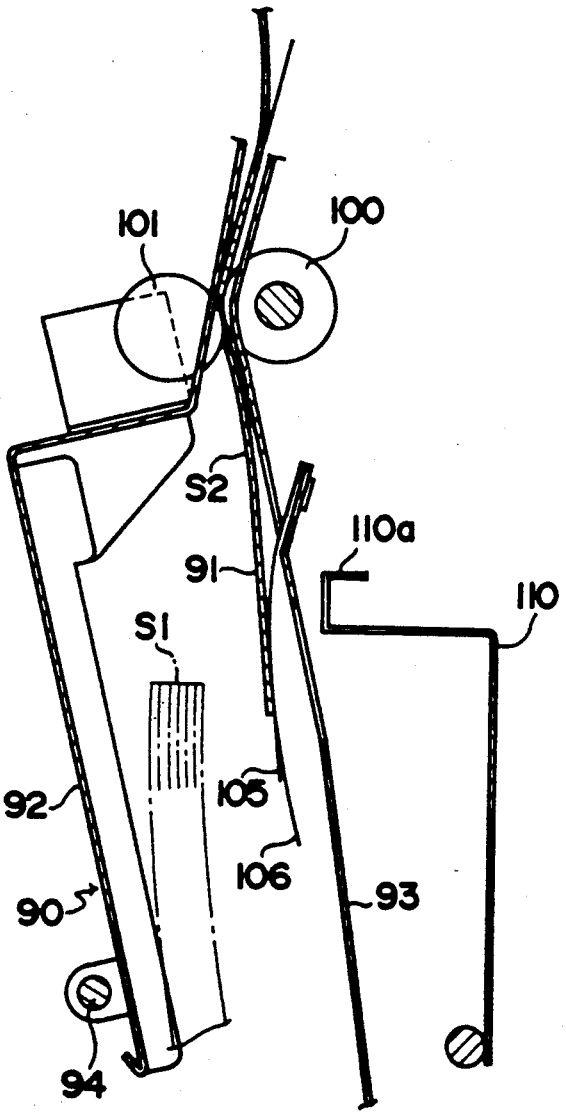

Additionally, as in the embodiment according to the present invention, when the head 110*a* of the pressing member 110 presses the upper portion of the copying papers S1, and if the pressing member 110 intersects the flexible sheets 105 at the notches 110*b*, the next copying paper is more readily stored in the stapling tray 90. More specifically, as shown in FIG. 4, while the head 110*a* of the pressing member 100 presses the upper portion of the copying papers S1 already stored, the flexible sheets 105 is positioned in the notchs 110*b* and not forced toward the left direction. Therefore, as shown in FIG. 5, the next transported copying paper S2 is stored in the stapling tray 90, as being sufficiently spaced from the copying papers S1 already stored, as in the case where the pressing member 110 is lifted off the stapling tray 90.

The above operation enables copying papers to be stored and correctly aligned in the stapling tray 90 sheet by sheet in the order of page while the copied image on each paper faces to the guide plate 93 side. When the previously mentioned ADF 30 with a document circulating function is used, the stapler 130 is actuated based on a stapling signal outputted at the timing synchronized with the completion of one cycle of copying operation and staples the copying papers at the stapling position (D). When the ADF 30 is not used, the stapler 130 is actuated and similarly staples the papers based on a stapling signal inputted by an operator.

Once the stapling operation has completed, the solenoid SL2 is turned ON, and the stopper 95 retreats to a position indicated by the dashed line shown in FIG. 1 so as to open the bottom of the stapling tray 90. At the same time, the motor M2 is switched to reverse operation, and the paddle wheel 120 rotates in the direction reverse to an arrow (c), thereby, the stapled one set of papers is ejected downward from the stapling tray 90 because of the weight as well the actuating force generated by the rotation of the paddle wheel 120, turning to the right and downward in FIG. 2.

More specifically, the stapled one set of papers turns to the right by the actuating force due to the reverse rotation of the paddle wheel 120, thereby the stapled set is ejected while the stapled portion at first leaves the stapling position (D).

Figure 7:
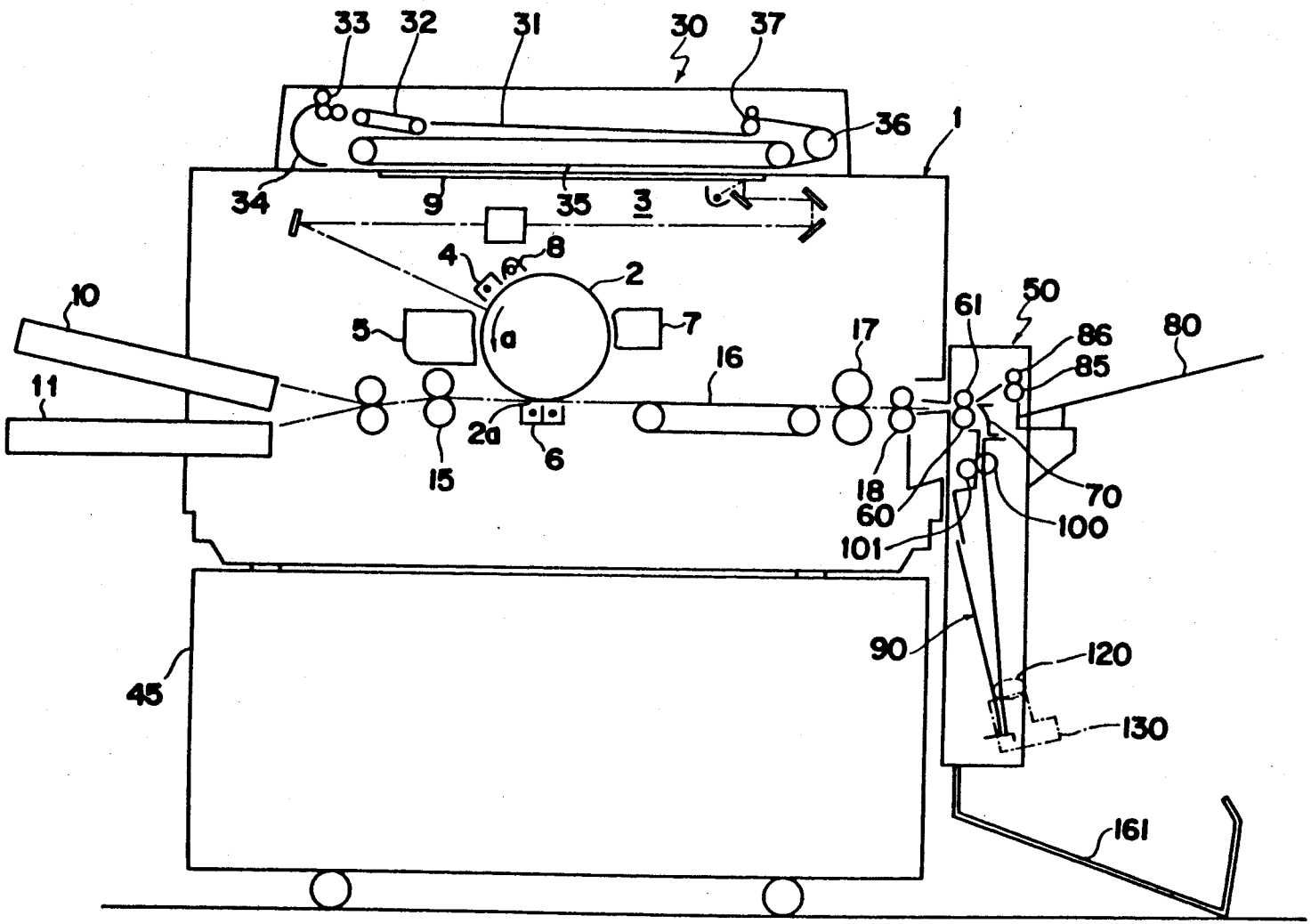

As described above, the one set of copying papers ejected from the stapling tray 90 is stacked in the stack box 161 shown in FIG. 7 or in the stack box 162 of the stack unit 160 shown in FIG. 6. When the set of copying papers is ejected from the stapling tray 90, the operations of the ADF 30 and the copying machine 1 restart to execute the next copying operation. Such a sequence of operations, including one cycle of copying operation and an operation of stapling duplicates prepared in the one cycle of copying operation, are repeated up to the number of sequences entered with the ten numerical keys.

Constitution and operation of stack unit

The stack unit 160 is described, below, by referring to FIG. 6.

The stack unit 160 is so arranged that the stack box 162 is connected through a fixture 164 to a belt 163 which is actuated by a motor M3 to rotate in the forward and reverse directions, in order to allow the upward or downward adjustment of the unit 160. Additionally, a photosensor SE4 for detecting the set of copying papers is aligned to openings 162*a* provided on both sides of the stack box 162 to detect the height of sets of copying papers stacked in the stack box 162.

More specifically, when each set of copying papers having been stapled is ejected from the stapling tray 90 and sequentially stacked in the stack box 162, and if the sensor SE4 detects the top of copying papers, the motor M3 is actuated to rotate in the direction of an arrow (d) and the stack box 162 moves downward in accordance with the rotation of the belt 163. As the stack box 162 moves downward, the top of copying papers is unlocked from the optical axis of the sensor SE4 and turns OFF the sensor, this in turn turns OFF the motor M3. Therefore, every set of copying papers is without fail ejected and stacked at a constant height.

Control panel

Figure 8:
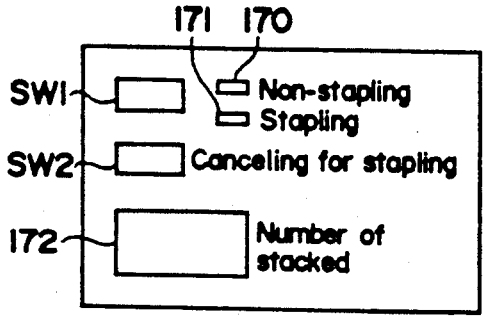

A control panel of the finisher unit 50 is described, below, by referring to FIG. 8.

SW1 is a mode select switch, and numeral 170 represents a non-stapling mode indicator LED, and numeral 171 represents a stapling mode indicator LED. In the starting stage, the non-stapling mode is started as a default mode. Every time the select switch SW1 is pressed, the stapling mode and the non-stapling mode are alternately designated, thereby the indicator LED 170 or 171 correspondingly lights up.

When using the previously mentioned ADF 30 to execute the stapling mode, the timing or the like of the stapling operation is automatically designated by communication between the ADF 30 and a controller on the copying machine 1, as described below. When the ADF 30 is not used to execute the stapling mode, the select switch SW1 is first pressed to designate the stapling mode, then, after the completion of a predetermined number of sets of copying papers, the select switch SW1 is pressed again to designate the non-stapling mode.

SW2 is a stapling mode canceling switch which cancels the stapling mode when pressed during the stapling mode with the ADF 30. For example, while preparing ten sets of copying papers, eight sets stapled and two sets unstapled, pressing the canceling switch SW2 during the processing of the eighth set of copying papers, will cause the ninth and tenth sets of copying papers will be ejected to the paper ejection tray 80 without undergoing stapling Numeral 172 represents an indicator for indicating the number of stacked sets, that is, the number of stapled sets of copying paper The numerical indication of the indicator 172 is incremented based on a signal from the controller on the copying machine 1, and the indicator 172 is reset based on a clear signal or the like from the controller.

Control circuit

Figure 9:
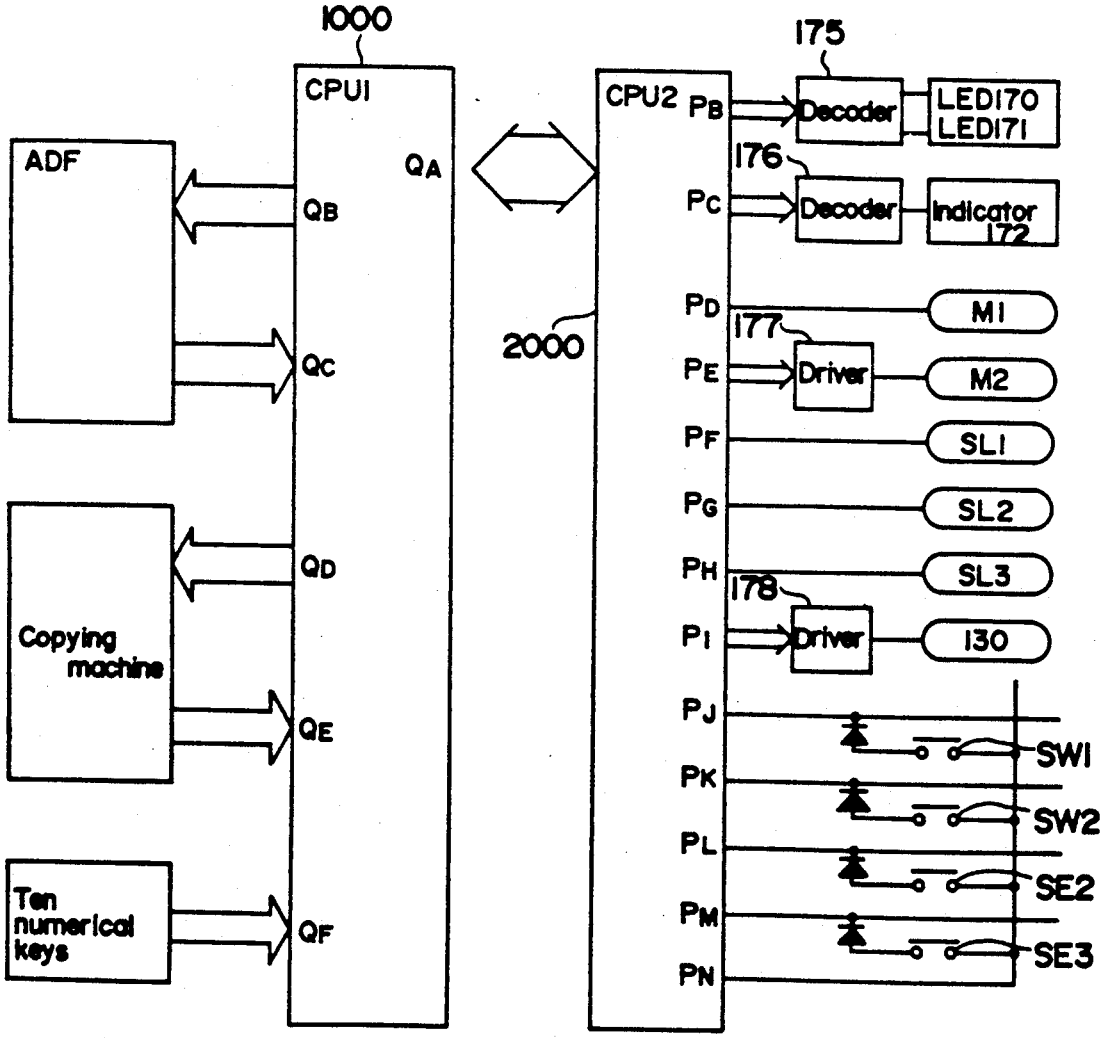

FIG. 9 illustrates a control circuit on the copying apparatus according to the invention The first CPU 1000 controls the operations of the ADF 30 and copying machine 1. With the CPU 1000, a signal for controlling various movable elements on the ADF 30 is output from a port QB, and a signal indicating the status of the ADF 30 is inputted to a port QC. A signal for controlling various movable elements on the copying machine 1 is output from a port QD and a signal indicating the status of the copying machine 1 is inputted to a port QE. Into a port QF, a numeric data from the ten numeral keys is inputted.

The second CPU 2000 controls the operation of the finisher unit 50. With the CPU 2000, indicator LEDs 170 and 171 are connected to a port PB via a decoder 175, and the indicator 172 for the number of stacked sets of duplicates is connected to a port PC via a decoder 176. The motor M1 for driving the rollers 60, 85 and 100 is connected to the port PD, and the motor M2 for driving the paddle wheel 120 is connected to a port PE via a forward/reverse capable driver 177. A port PF is connected to the solenoid SL1 for driving the diverting member 70; a port PG is connected to the solenoid SL2 for driving the stopper 95; and a port PH is connected to the solenoid SL3 for driving the pressing member 110. To a port P1, the stapler 130 is connected via a driver 178. Additionally, to ports PJ through PN, the switches SW1 and SW2, and the sensors SE2 and SE3 are correspondingly connected.

Further, the above first CPU 1000 and second CPU 2000 exchange an ADF signal, a stapling signal, a copy signal, an ejection signal and a copy wait signal via the ports QA and PA.

Figure 10:
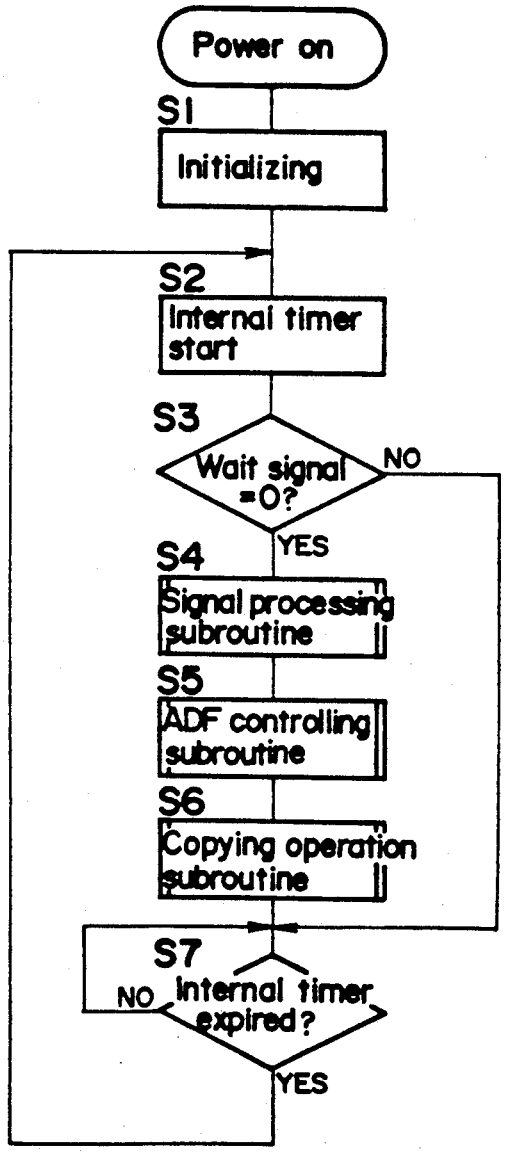

FIG. 10 is a flow chart schematically showing the processing operation carried out by the first CPU 1000.

When the power is turned ON, the first CPU 1000 is reset, and the program is started, clears a RAM and various resisters built in the first CPU 1000 and initializes various movable elements at step S1. Next, the internal timer is started at step S2. The internal timer decides a required duration of the routine of the first CPU 1000.

At step S3, the CPU 1000 judges the status of a wait signal transferred from the second CPU 2000. If the level of wait signal is at "1", the CPU 1000 directly proceeds to step S7. If the level of wait signal is at "0", the CPU 1000 runs the signal processing subroutine at step S4, and runs the ADF controlling subroutine at step S5, then runs the subroutine for controlling copying operation at step S6, further proceeds to step S7.

At step S7, the CPU 1000 judges the completion of one cycle of the internal timer previously started at step S2. When it judges that one counting cycle of the internal timer has completed, the CPU 1000 returns to step S2.

Figure 11:
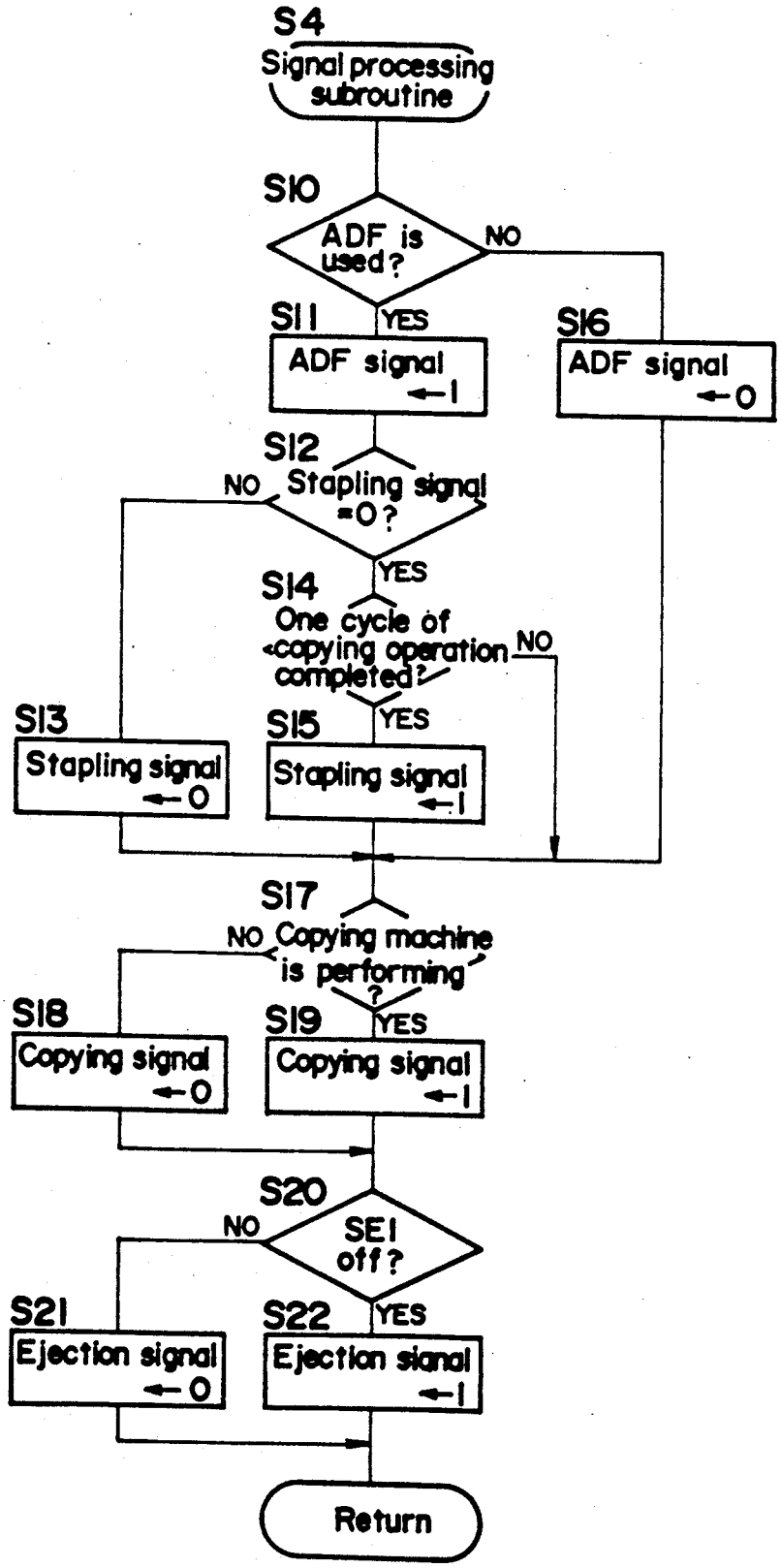

FIG. 11 is a flow chart showing the signal processing subroutine executed in the step S4 of the main routine.

First, whether or not the ADF 30 is currently used at step S10 is judged. If the ADF 30 is not used, an ADF signal is reset at the level of "0" at step S16, then the CPU 1000 proceeds to step S17. If the ADF 30 is currently used, the ADF signal is set at the level of "1" at step S11 and whether or not a stapling signal is at the level of "0" at step S12 is judged. If the stapling signal has been set at the level of "1", the stapling signal is set at the level of "0" at step S13 and the processing goes to step S17. If the stapling signal has been reset at the level of "0", whether or not one cycle of copying operation has completed at step S14 is judged. If one cycle of copying operation has completed, the processing goes to step S17. If one cycle of copying operation has not completed, the stapling signal is set at the level of "1" at step S15 and the processing goes to step S17.

At step S17, whether or not the copying machine 1 is performing a copying operation is judged. If the copying

1 is not performing a copying operation, a copy signal is set at the level of "0" at step S18. If the copying machine 1 is performing a copying operation, the copy signal is set at the level of "1" at step S19. Next, at step S20, whether or not the sensor SE1 is in the OFF status is judged. The sensor SE1 is turned OFF, when the leading edge of a copying paper leaves the pair of the ejection rollers 18 on the copying machine 1. Accordingly, when the sensor SE1 is in the ON status, an ejection signal is reset at the level of "0" at step S21. When the sensor SE1 is turned OFF, the ejection signal is set at the level of "1" at step S22, thereby the subroutine is terminated.

Figure 12:
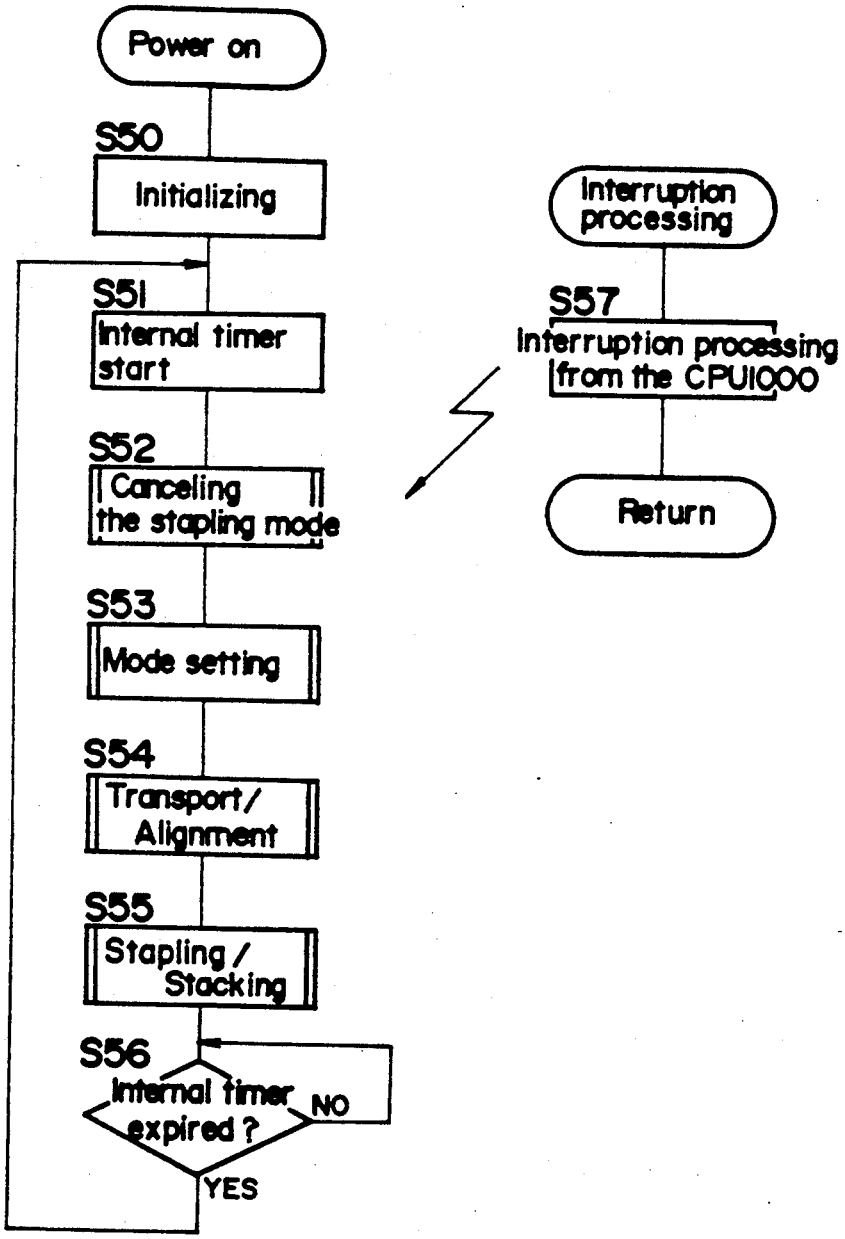

FIG. 12 is a flow chart showing the main routine of the second CPU 2000.

Once the second CPU 2000 is reset to start the program, first clears a RAM and initializes various registers and each unit. Next, the internal timer is started at step S51. The internal timer determines a duration required for one cycle of the main routine.

Then, the subroutines at steps S52 through S55 are called. When all the subroutines have been terminated, the second CPU 2000 at step S56 waits for the completion of counting cycle of the internal timer and returns to step S51. With various times used in various subroutines, the count of each timer is performed based on the duration of one cycle of the main routine.

Additionally, upon the interruption request from the first CPU 1000 on the copying machine 1, the second CPU 2000 executes the interruption processing at step S57.

Figure 13:
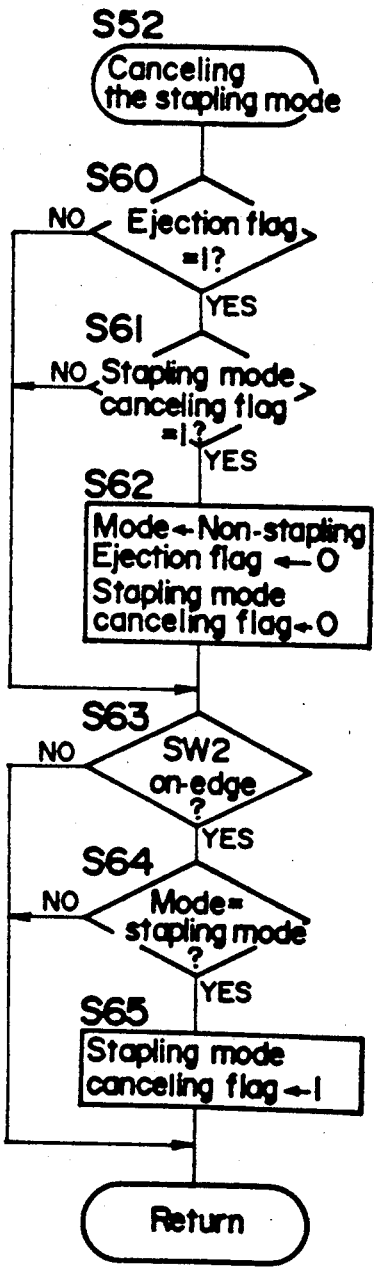

FIG. 13 is a flow chart showing the subroutine at step S52 for canceling the stapling mode.

First, whether or not an ejection flag is at the level of "1" at step S60 is judged, then whether or not a stapling mode canceling flag is at the level of "1" at step S61 is judged. The ejection flag is set at the level of "1" when the stapled set of copying papers is stored in the stack box 161, and is reset at "0" when the copying papers prepared in the next cycle of copying operation are stored in the stapling tray 90. Additionally, the stapling mode canceling flag is set at "1" when the canceling switch SW2 is turned ON. If both the ejection flag and the stapling mode canceling flag are set at the level of "1", the non-stapling mode as a current operation mode at step S62 is designated, and the ejection flag is set at "0" and the stapling mode canceling flag is reset at "0".

Next, whether or not the signaling status of the canceling switch SW2 is on-edge status at step S63 is judged. When the signal level is on-edge status whether or not the stapling mode has been designated as a current operation mode at step S64 is judged. If the stapling mode has been designated, the stapling mode cancelling flag is set at the level of "1" at step S65. More specifically, the canceling switch SW2 is arranged so as to accept canceling instruction even during a copying operation, that is, so as to change the operation mode from the stapling mode to the non-stapling mode when the stapling mode cancelling flag is set at "1" and copying papers for current one cycle of copying operation are stapled then stored in the stack box 161 at steps S60 through S62.

Figure 14:
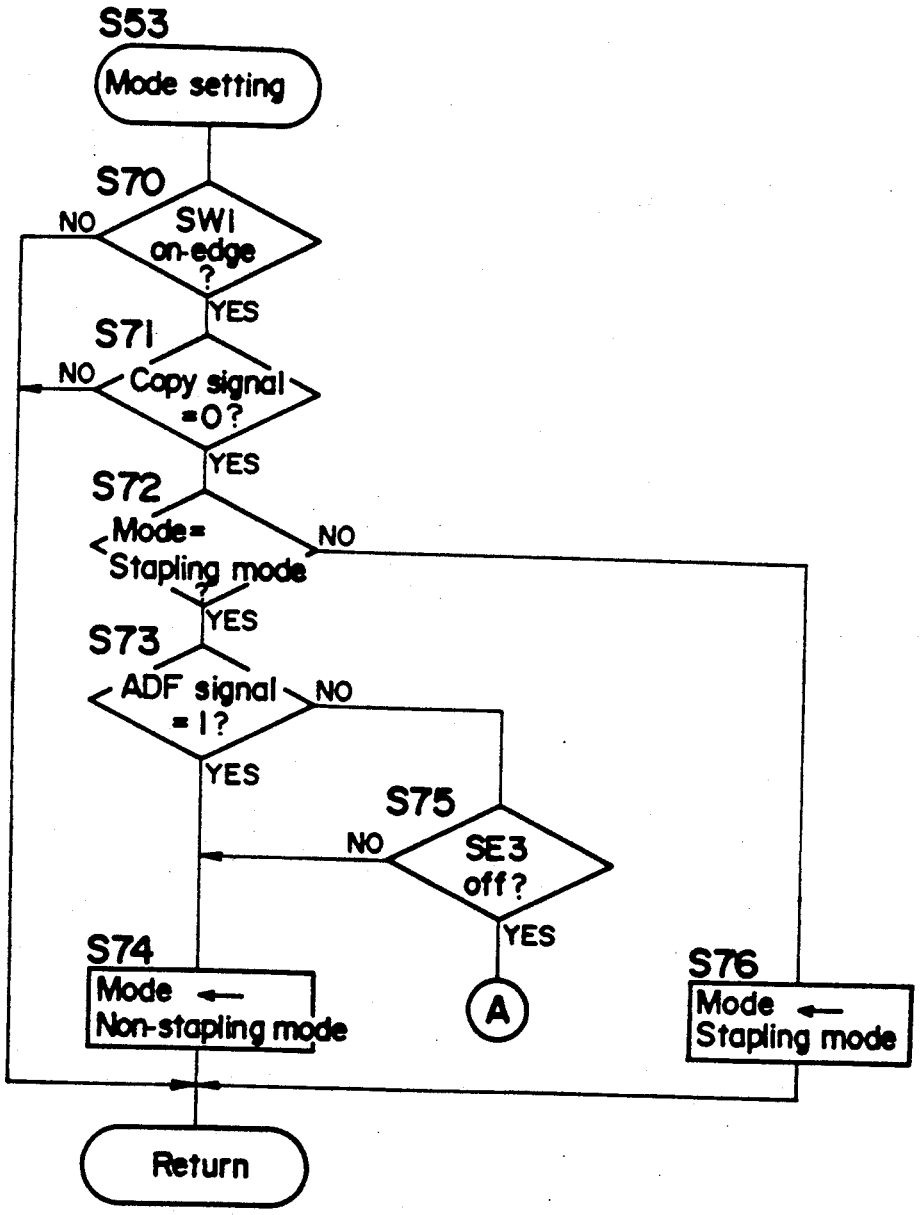

FIG. 14 is a flow chart showing the mode setting subroutine executed at step S53.

First, whether or not the signaling status of the mode select switch SW1 is on-edge status at step S70. When the similar status is on-edge status, whether or not the copy signal has been reset at the level of "0" at step S71 is judged. The level of the copy signal is maintained at "1" when the copying machine 1 is performing a copying operation. Accordingly, it is judged that the level of the copy signal is at "0" and the copying machine 1 is not performing a copying operation, whether or not the stapling mode has been designated as the current operation mode at step S72 is judged. If the stapling mode has not been designated, the stapling mode at step S76 is designated. If the stapling mode has been designated, whether or not the level of ADF signal is at "1" at step S73 is judged, that is, whether or not the ADF 30 is currently used for the copying operation. If the ADF 30 is used, the non-stapling mode is designated at step S74. If the ADF 30 is not currently used, whether or not the sensor SE3 for detecting a copying paper in the stapling tray 90 is in the OFF status at step S75 is judged. If the sensor SE3 has not been turned OFF, the stapling mode is similarly designated at step S74. If the sensor SE3 is put in the OFF status, the CPU 2000 proceeds to step S514 of the transport/alignment subroutine shown in FIG. 15*b*. More specifically, when the copying operation and the stapling operation are performed without using the ADF 30, the stapling operation is forcibly commenced by pressing the switch SW1, since a signal for automatically executing the stapling operation (stapling signal) is not generated. Additionally, when the sensor SE3 is in the OFF status, the stapling operation is performed, since there are copying papers present in the staple tray 90. However, when the sensor SE3 is in the ON status, only the current operation mode is changed to the non-stapling mode, instead of executing the stapling operation, since there are no copying papers present in the stapling tray 90.

Figure 15A:
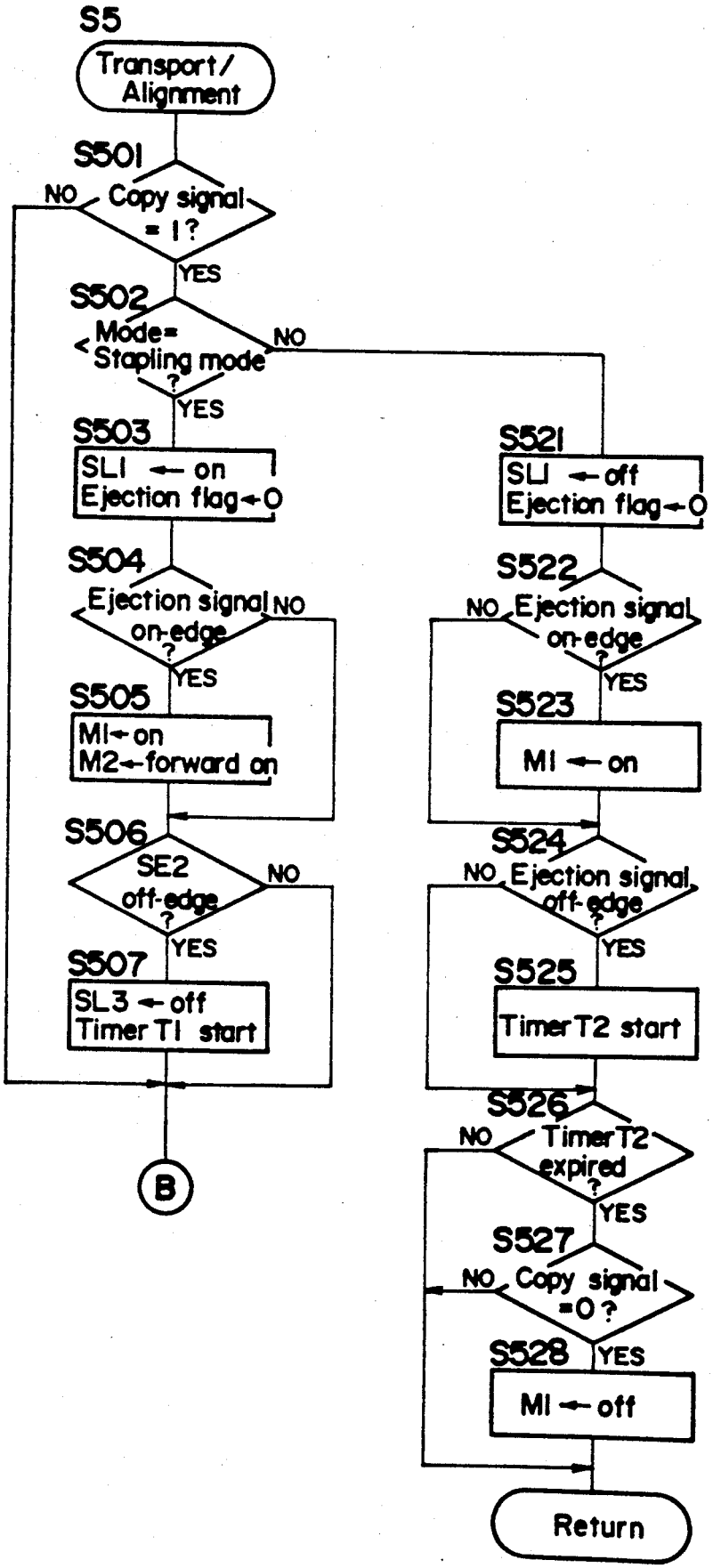
FIGS. 15*a* and 15*b* are flow charts showing a subroutine for paper transport/alignment.
Figure 15B:
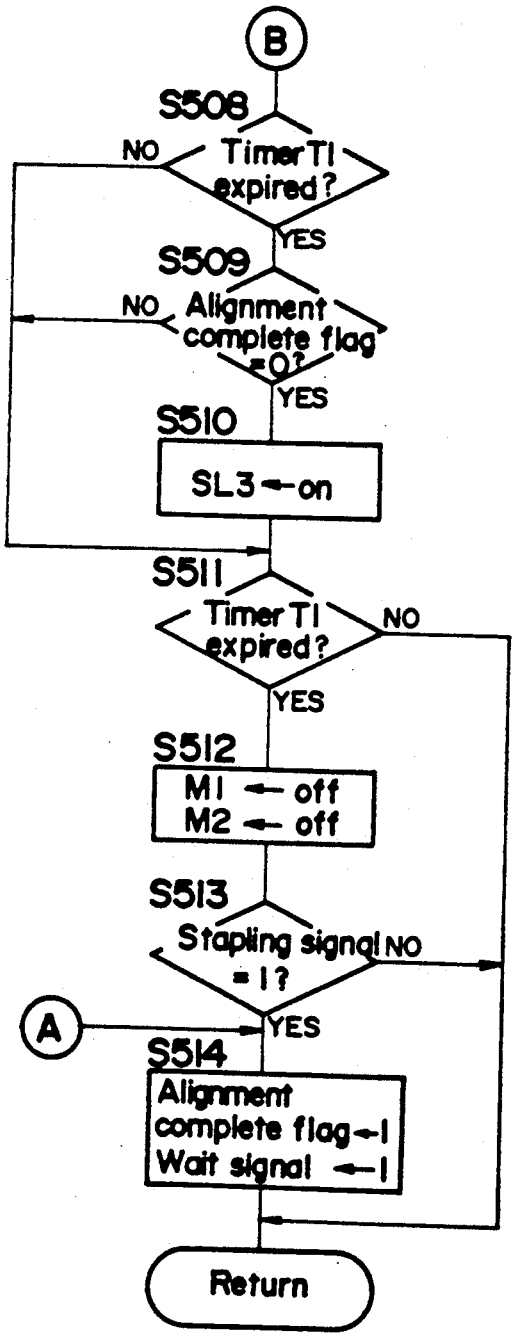

FIGS. 15*a* and 15*b* are flow charts showing the transport/alignment subroutine performed at step S54.

First, whether or not the level of copy signal is at "1" at step S501 is judged, and whether or not the stapling mode has been designated as the current operation mode at step S502 is judged. If the above two criteria are satisfied, at step S503, the solenoid SL1 is turned ON, when the diverting member 70 shifts to the position indicated by the solid line in FIG. 1, and the ejection flag is reset at "0".

Next, the signaling status of the sensor SE1 located in the ejection area of the copying machine 1 is on-edge status at step S504 is judged, then at step S505 the motor M1 turns ON, and the motor M2 also turns ON to rotate in the forward direction, thereby the rollers 60, 85 and 100 are driven, and the paddle wheel 120 is actuated to rotate forward in the direction of the arrow (c).

Next, the signaling status of the sensor SE2 disposed on the stapling passage is in off-edge status at step S506 is judged, then at step S507 the solenoid SL3 turns OFF and a timer T1 starts. Turning OFF the solenoid SL3 retreats the head 110*a* of the pressing member 110 from the stapling tray 90. Then, once the the completion of one counting cycle of the timer T1 at step S508 is confirmed, whether or not the alignment complete flag is at the level of "0" at step S509 is judged. If the above two criteria are satisfied, at step S510 the solenoid SL3 turns OFF to insert the head 110*a* of the pressing member 110 into the stapling tray 90 and the head 110*a* presses the upper portion of the stored copying papers.

Also the completion of one counting cycle of the timer T1 at step S511 is confirmed, and at step S512 the motors M1 and M2 turn OFF. Whether or not the level of the stapling signal is at "1" at step S513 is judged. If the level of the stapling signal is at "1", at step S514, the level of the alignment complete flag is set at "1" to initiate the stapling operation, and the level of the wait signal is set at "1", in order to inhibit the operation of the copying machine 1. If the level of the stapling signal has been reset at "0", the processing returns to the main routine and proceeds to the next subroutine S55, because it is not definable as to whether or not the stapling operation should be initiated.

Additionally, if the criteria at previous step S502 are unsatisfactory and the non-stapling mode is executed, at step S521 first the solenoid SL1 turns OFF and the diverting member 70 maintains in the position indicated by the dashed line in FIG. 1. At this time, the ejection signal is reset at "0". Then, the status of the ejection signal has been on-edge at step S522 is confirmed, the motor M1 turns OFF in order to drive the rollers 60 and 85 at step S523.

Next, once the status of the ejection signal has been off-edge at step S524 is confirmed, a timer T2 starts step S525. The duration at which end a copying paper is completely ejected is incorporated into the timer T2. When the counting cycle of the timer T2 at step S526 is judged, and at next step S527 when the level of the copy signal is at "0", the motor M1 turns OFF at step S528 and processing terminates this subroutine.

Figure 16:
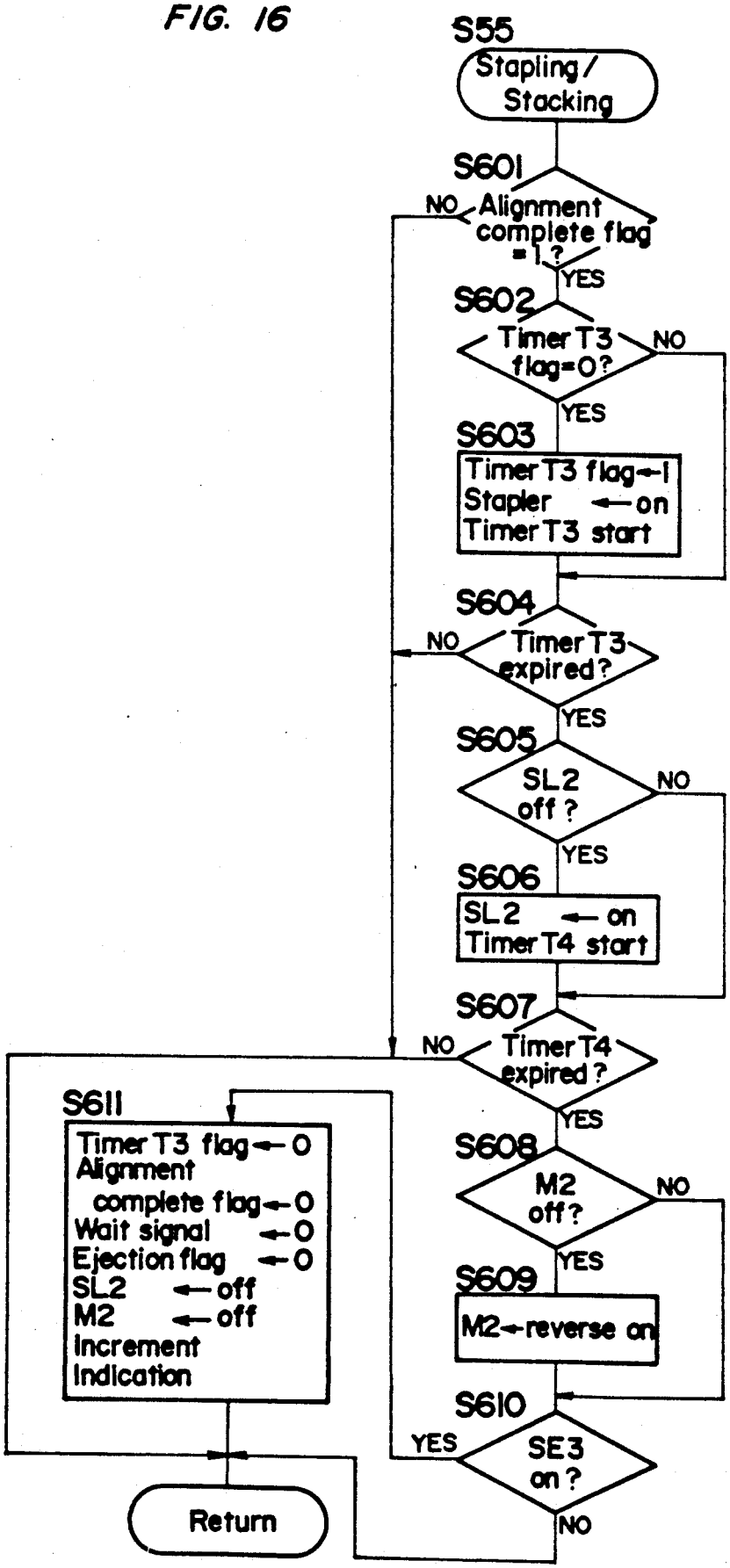

FIG. 16 illustrates the stapling/stacking subroutine commenced at step S55 in the main routine.

First, whether or not the level of the alignment complete flag is set at "1" at step S601 is judged. Then, whether or not the level of timer T3 flag is reset at "0" at step S602 is judged. If both the criteria are satisfied, which means the completion of alignment of copying papers stored within the stapling tray 90, at step S603 the level of the timer T3 flag is set at "1" and the stapler 130 is turned ON in order to staple the copying papers. Additionally, the stapler start signal is turned OFF instantaneously. At the same time, the timer T3 is started. The timer T3 serves to synchronize the timing to open up the stopper 95. Once the the completion of counting cycle of the timer T3 at step S604 is confirmed, at step S605 whether or not the solenoid SL2 has been turned OFF is judged. If the solenoid SL2 is at the OFF status, at step S606 the solenoid is turned ON to open up the stopper 95 and a timer T4 is started, which allows the stapled copying papers to fall freely. The timer T4 is provided to synchronize the timing to reverse the paddle wheel 120. When the completion of one counting cycle of the timer T4 is detected at step S607, the motor M2 is in the OFF status is detected at step S608, and the motor M2 actuates in the reverse direction at step S609, so as to turn the paddle wheel 120 in the direction reverse to the arrow (c). This arrangement allows copying papers to fall while turning to the right direction in FIG. 2, thereby the stapled set of the copying papres is ejected from the stapling tray 90 while the stapled portion does not interfere with the stapling position (D).

Next, whether or not the sensor SE3 which detects the copying papers stored in the stapling tray 90 is in the ON status at step S610 is judged. If the sensor SE3 is in the ON status, which means that set of the copying papers ejected from the stapling tray 90 has been detected, at step S611 the timer T3 flag, the alignment complete flag and the wait signal are reset respectively at the level of "0", and the ejection flag is set at the level of "1", and simultaneously, the solenoid SL2 and the motor M2 are turned OFF, then the second CPU 2000 increments the number of stacked sets of the display 172, and indicates the number with a display 172.

Mounting mechanism of stack unit

The mounting mechanism of the stack unit 160 is described by referring to FIGS. 20 through 25*a* and 25*b*.

Figure 22:
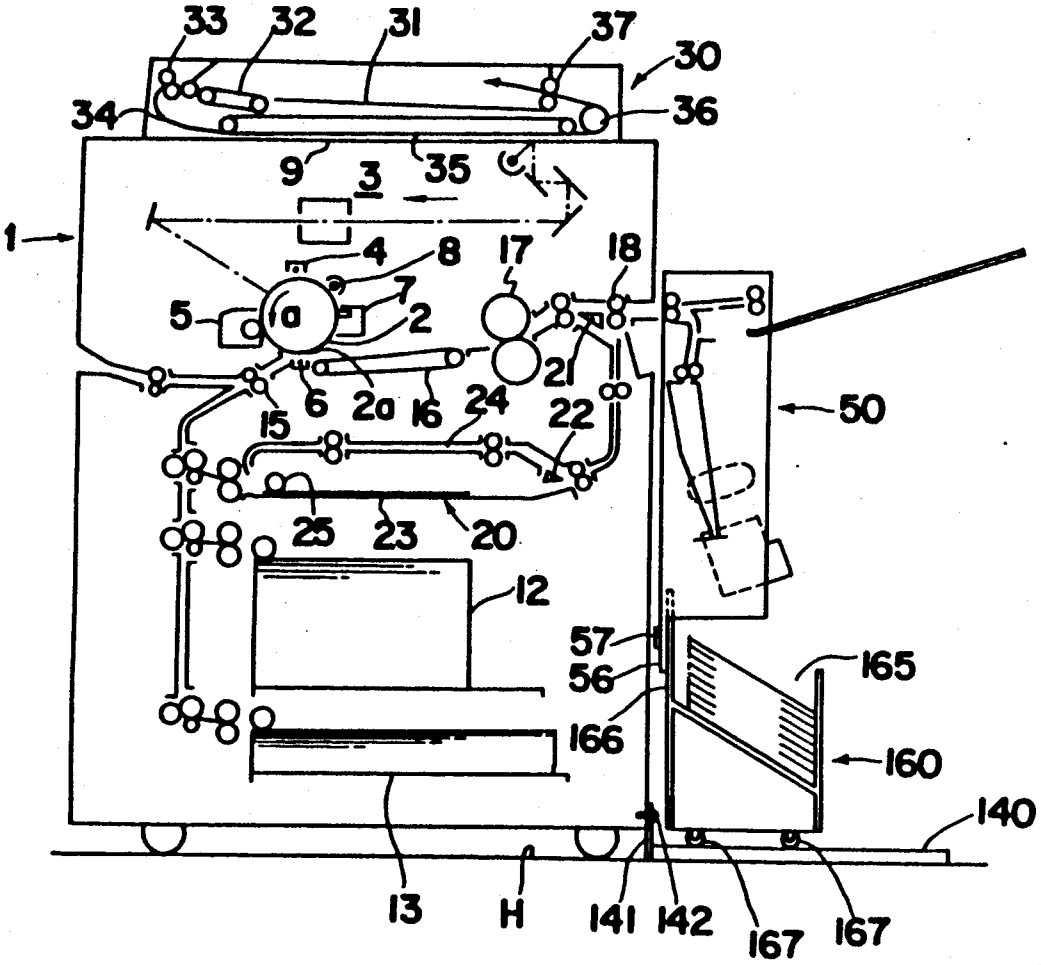
FIG. 22 is an explanatory drawing showing a state where the stuck unit is attached to the copying machine.

A copying machine 1 in FIG. 22 is similar to that of in FIG. 7, except that the desk 45 of the latter embodiment is incorporated into the apparatus itself, and this type of copying machine 1 has a built-in paper feeder, and paper refeeder.

When using a paper re-feeder 20 disposed within this type of copying machine, copying papers having an image already formed on the surface thereof are transported downward after their transporting directions being selectively diverted by a switching tongue 21. More specifically, the papers diverted by a switching tongue 22 are either directly stored in the re-feeding tray 23, or stored in the re-feeding tray 23 via the diverting transport path 24 and re-fed by the re-feeding roller 25.

Figure 20:
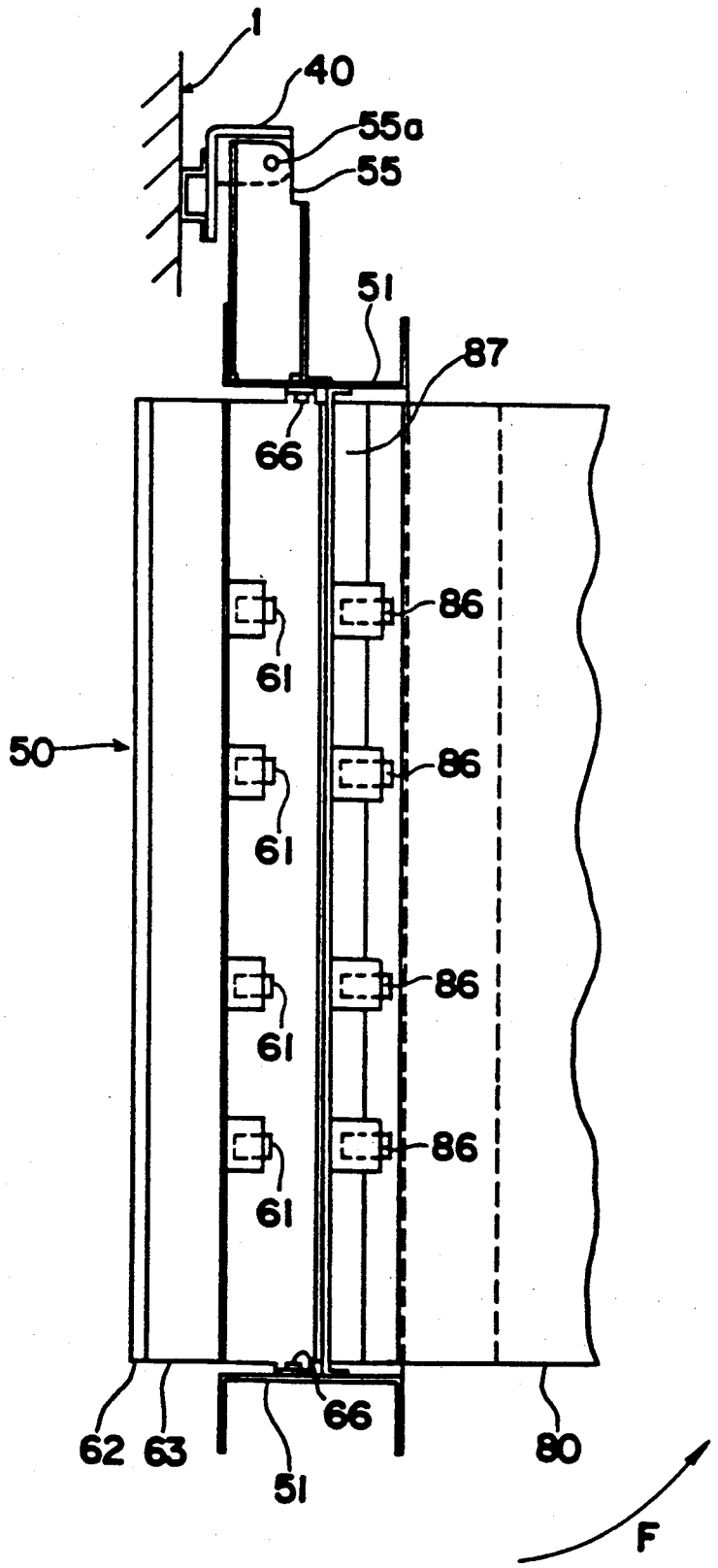
FIG. 20 is plan view showing an attaching mechanism of a finisher unit.
Figure 21:
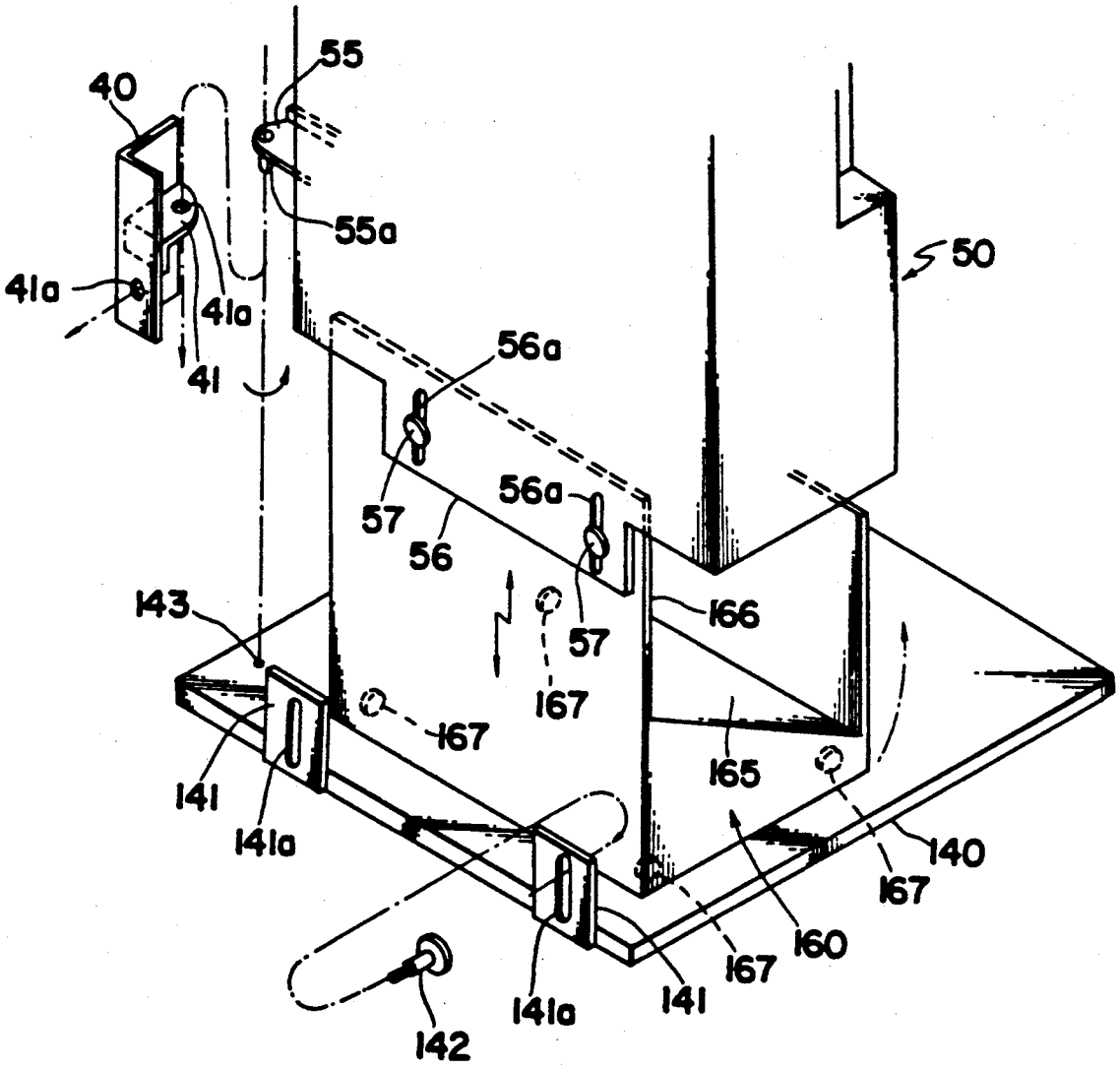
FIG. 21 is a perspective view showing a mechanism to connect a stuck unit with a copying machine.

Incidentally, as shown in FIGS. 20 and 21, the finisher unit 50 has a support plate 55 which is laterally disposed on a frame 51 toward the copying machine 1. The copying machine 1 has a bracket 40 in a position corresponding with that of the support plate 55, thereby a pin 55*a* on the support plate 55 is engaged into a hole 41*a* of a support plate 41 on the bracket 40. The combination of support plate 55 and bracket 40 is provided in two positions, that is, upper and lower positions, thereby the finisher unit 50 may be detached from the copying machine 1, pivotally on the upper and lower pins 55*a* toward the arrow (F) direction.

At the same time, the stack unit 160 has a container 165, which opens toward the upper and front directions, and casters 167 on the bottom thereof, and is movably placed on a base plate 140. Additionally, bolts 57 secure a rear plate 166 of the stack unit 160 onto the finisher unit 50 through long holes 56*a* formed on a rear plate 56 of the finisher unit 50.

The base plate 140 is directly placed on a floor (H), and bolts 142 secure the plate 140 to the copying machine 1 through long holes 141*a* formed on tabs 141.

Figure 23:
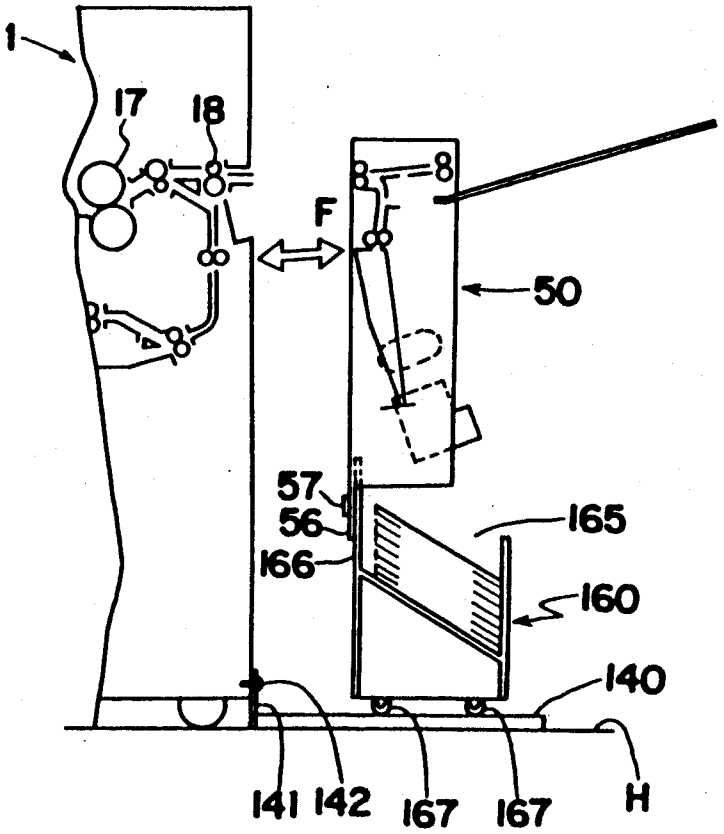
FIG. 23 is an explanatory drawing showing a state where the finisher unit and the stack unit are detached from the copying machine.
Figure 25A:
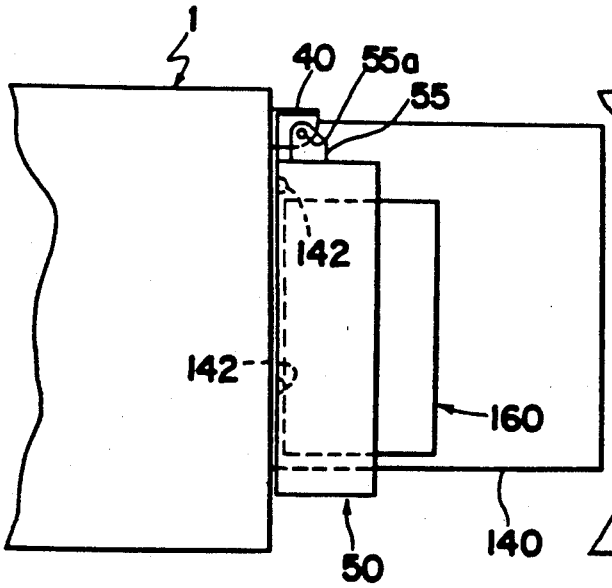
FIG. 25*a* is a plan view showing a state where the stuck unit is connected to the copying machine.
Figure 25B:
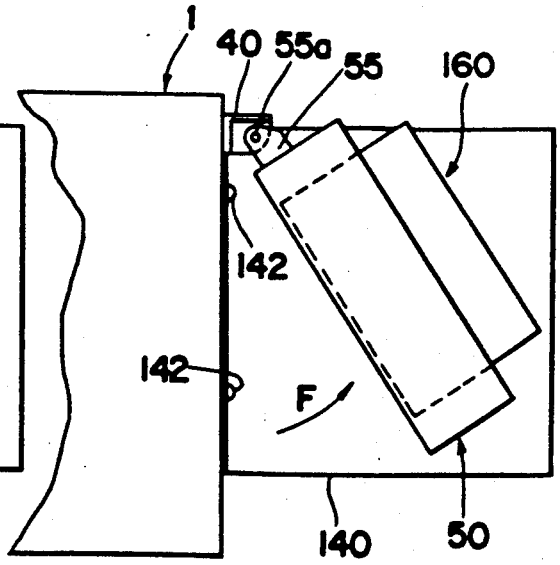
FIG. 25*b* is a plan view showing a state where the finisher unit and the stuck unit are opened up.

In essence, the finisher unit 50 is attached to the copying machine 1, whereby allowed to open up when turned laterally in the arrow (F) direction indicated in FIGS. 23 and 25*b*. The base plate 140 is placed directly on the floor (H), so that its load is exerted on the floor (H). The stack unit 160 is movably supported by the base plate 140. Though connected with each other by the bolts 142, the positional relation between the base plate 140 and the copying machine 1 may be adjusted within a range of the length of the long holes 141*a*. The finisher unit 50 and the stack unit 160 are connected by the bolts 57, and may be moved as entity in the horizontal plane, and their vertical positional relation may be adjusted within a range of the length of the long holes 56*a*.

Figure 24:
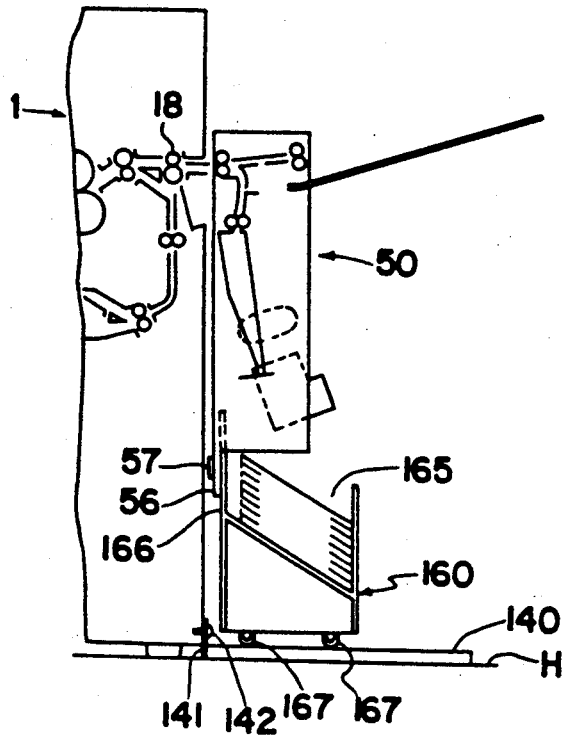
FIG. 24 is an explanatory drawing a state where the copying machine is slightly sunken into a floor material.

Accordingly, if paper jamming should occur within the finisher unit 50, the jammed papers are readily removed by opening up the finisher unit 50 in the arrow (F) direction as shown in FIGS. 23 and 25*b*. In this procedure, naturally, the stack unit 160 also rotationally moves. The height of each of the units 50 and 160 is independently adjusted. Correspondingly, even if the floor (H) partially sinks after the height adjustment, for example, as indicated in FIG. 24, if the floor (H) sinks in the copying machine 1 side, the sinkage is automatically compensated because the bolts 142 and 57 proportionally move along the long holes 141*a* and 56*a*.

Other embodiment

As described above, in the above enbodiment, once the sensor SE2 detects the leading edge of the next copying paper [indicated by YES a. step S506], the solenoid SL3 is turned OFF to release the pressure exerted by the pressing member 110 upon the stored papers [step S507]. In this case, the satisfactory timing of releasing the pressure is at least immediately before the leading edge of the next copying paper reaches the vicinity of the head 110*a*. Additionally, the timing at which the solenoid SL3 is turned ON to have the pressing member 110 press the copying paper is not necessarily limited to the above step S510.

Figure 17:
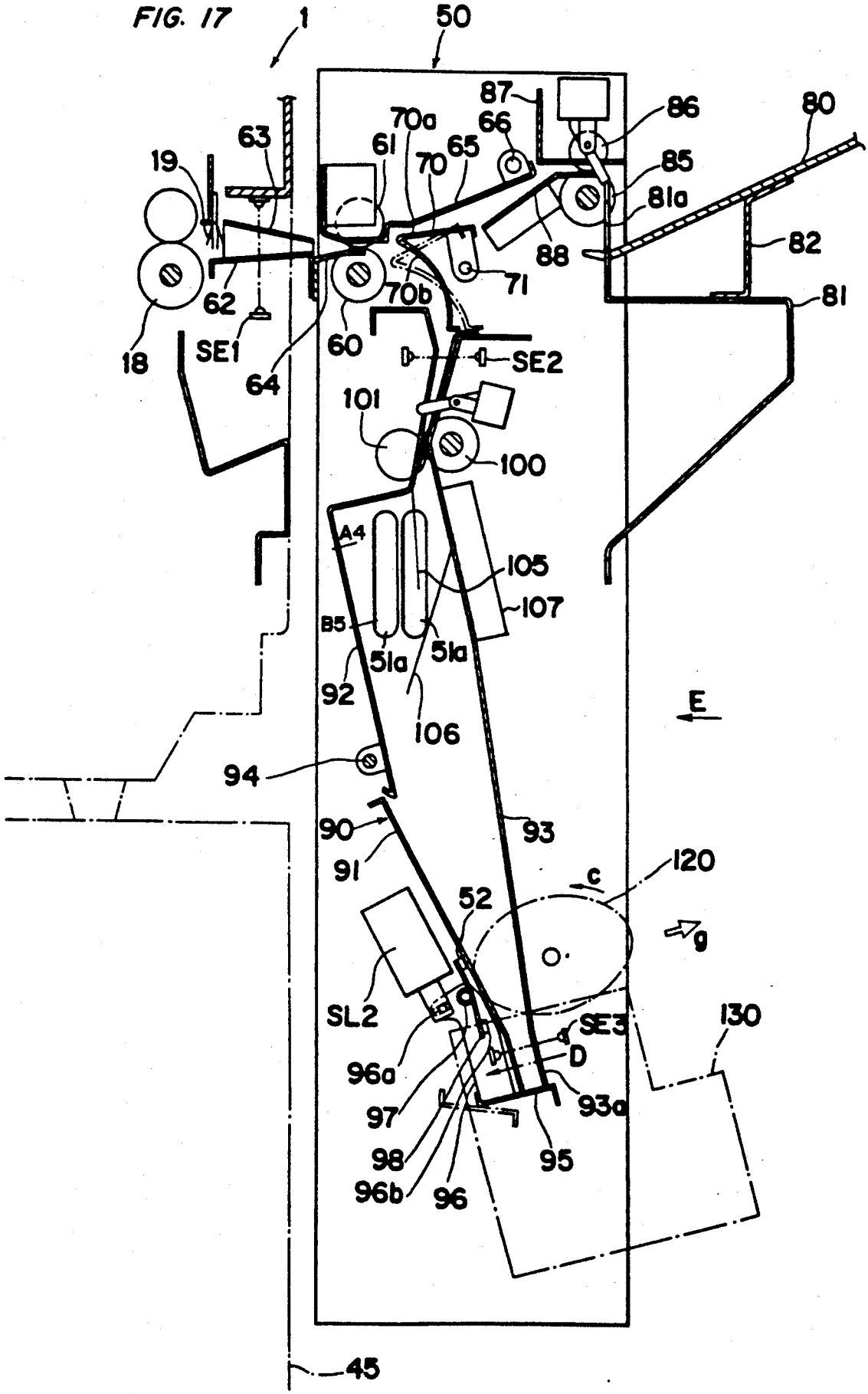
FIG. 17 is an internal composition showing a paper container of other embodiment.
Figure 18:
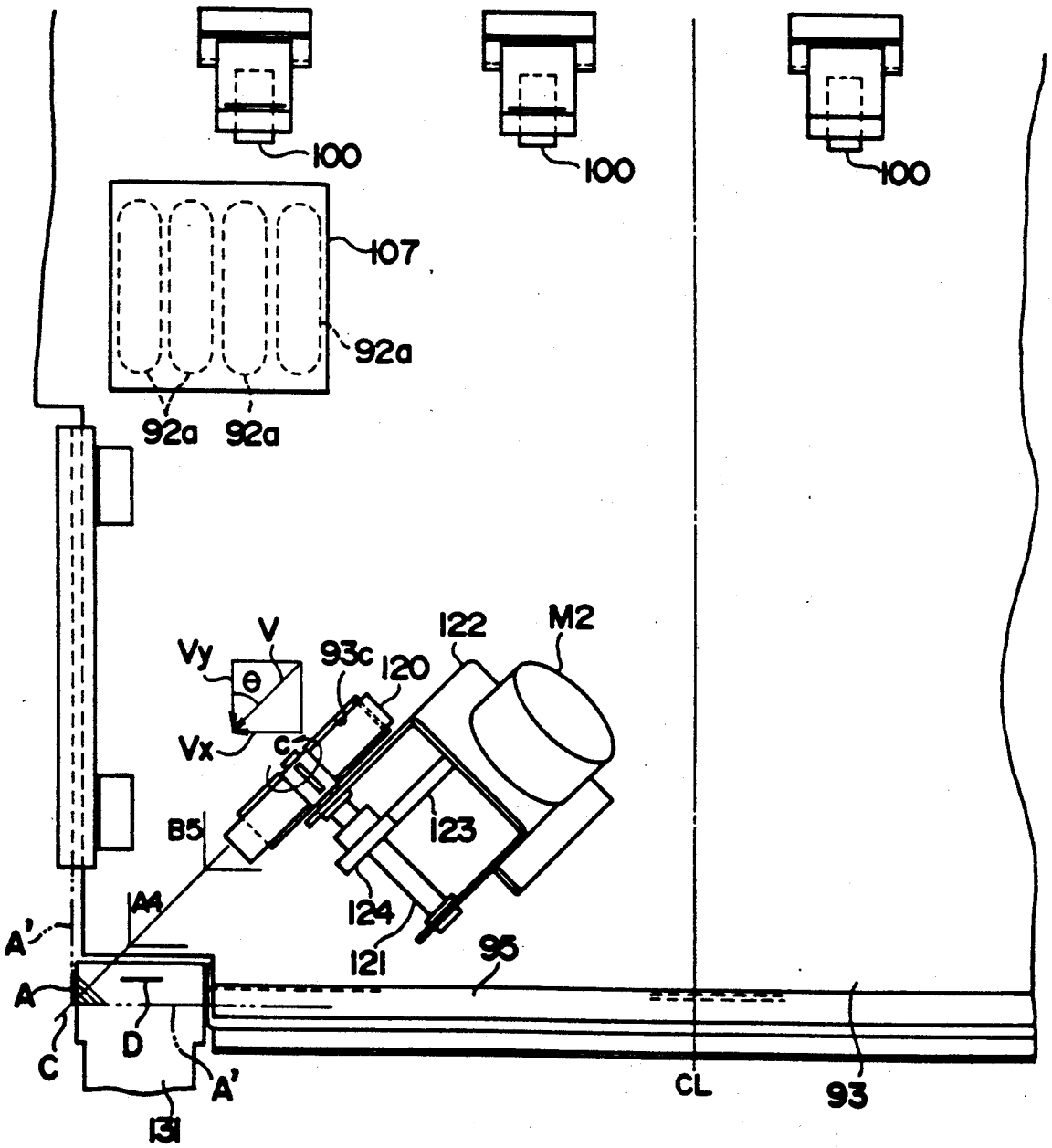
FIG. 18 is a side elevational view taken in the direction of the arrow E in FIG. 17.

Instead of the pressing member 110, an arrangement may be incorporated, as shown in FIGS. 17 and 18, to correct the curled area around the upper portion of copying papers stored in the stapling tray 90; a fan 107 is disposed on the external left or right side of the guide plate 93, thereby an air flow from the fan 107 is directed into the stapling tray 90 then to the upper portion of the stored copying papers. In this case, the air flow is readily directed to the upper portion of the stored copying papers, since slits 51*a* are formed on the frame 51, slits 92*a* are formed on the guide plate 92 so as to these slits are in positions directly facing the fan 107. Additionally, such a fan 107 is energized only when the curl of copying papers is extremely large.

The length of the flexible sheets 105, which is provided to ensure smooth storage of a copying paper, may be smaller, as indicated by FIG. 17.

Furthermore, in the above embodiment, the rotation of the paddle wheel 120 is reversed when ejecting stapled papers from the stapling tray 90. However, if the stroke of stapler 130 is large and if the stapling position (D) is out of an area to which a copying paper falls, it is not necessary to reverse the rotational direction of the paddle wheel 120. The paddle wheel 120 may be shifted outward (arrow (g) direction, see FIG. 1) to ensure the smooth fall of copying papers, or turned forward in the arrow (c) direction.

Figure 19:
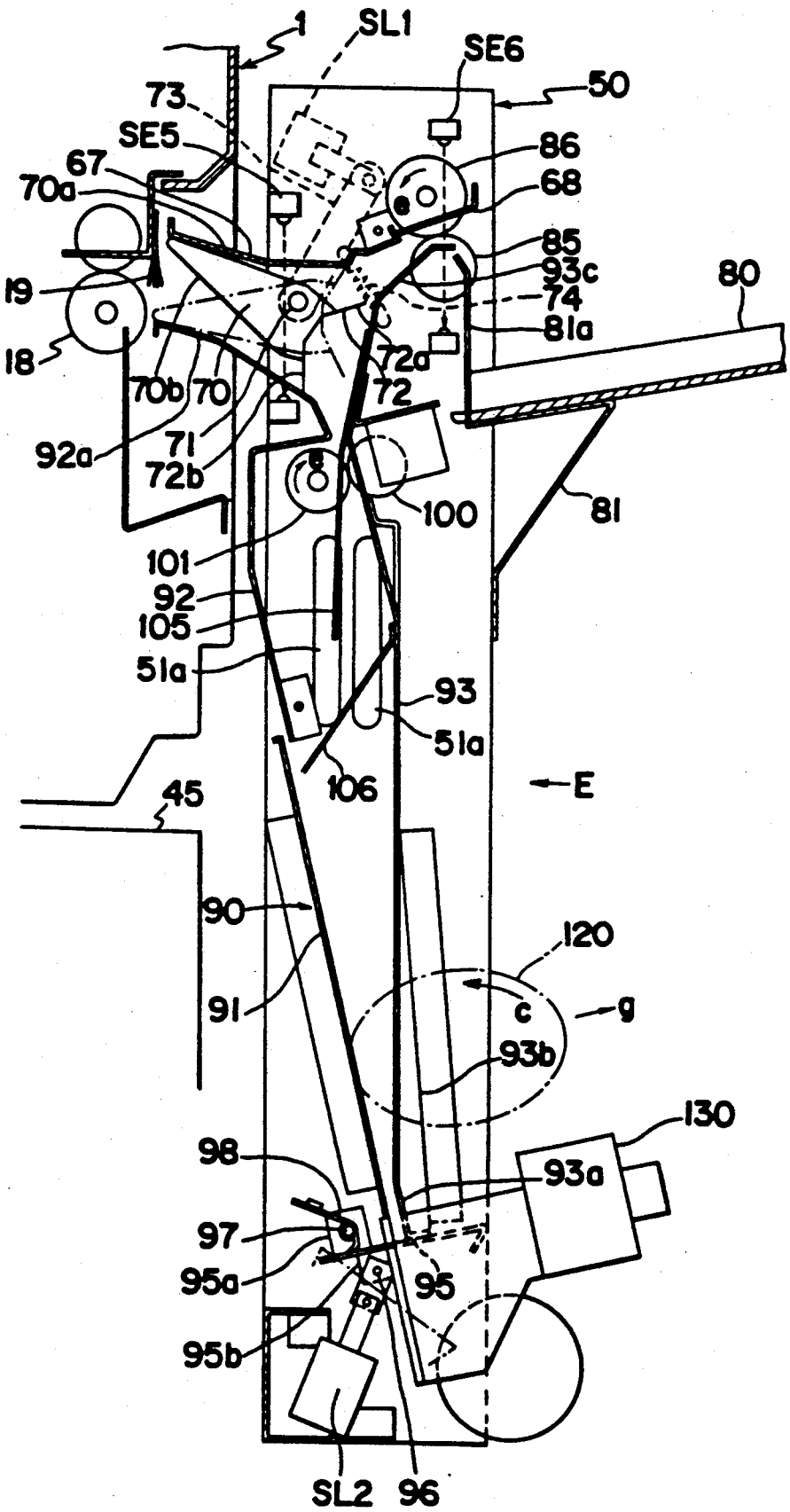
FIG. 19 is an internal composition showing a paper container of other embodiment.

FIG. 19 illustrates still another embodiment of the present invention.

This embodiment basically resembles the embodiment in FIGS. 17 and 18 in that an air flow is fed through slits 51*a*, but differs from the latter in that a bill-shaped diverting member 70 serving as a cam has replaced the plate-shaped diverting member 70. The new diverting member 70 is actuated by means of a solenoid SL1 is connected to the shaft 71. To detect a passing copying member, light transmission-type photosensors SE5 and SE6 are incorporated.

Other members are represented by the reference numerals identical with the equivalent members in FIGS. 1 through 17.

Figure 26:
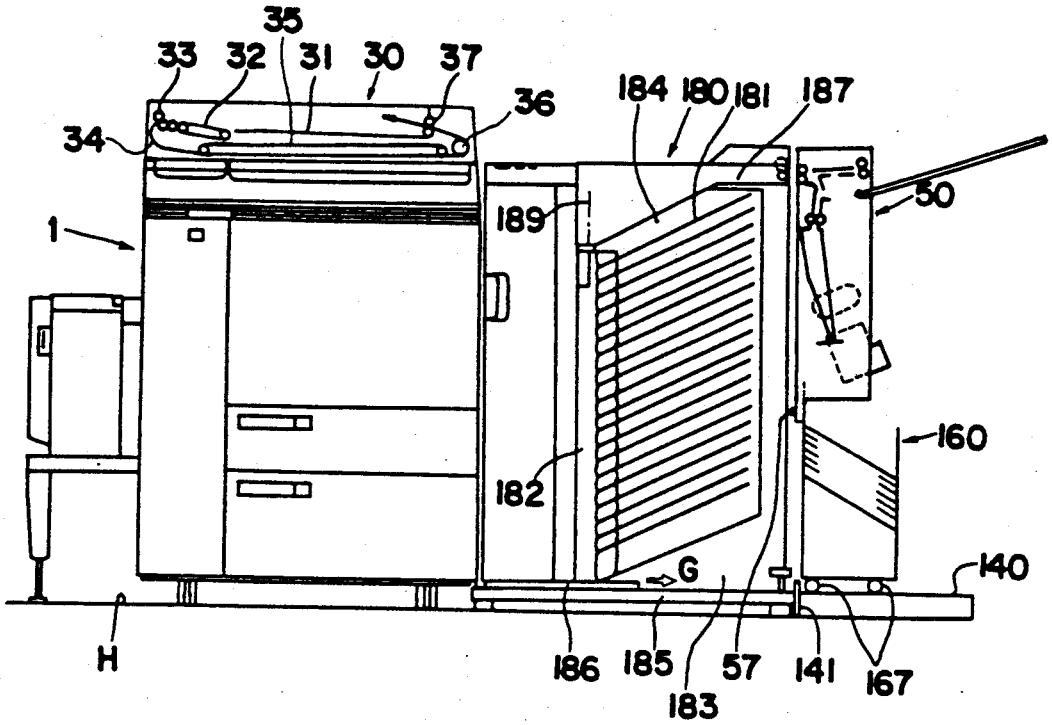
FIG. 26 is an explanatory drawing where a sorter is incorporated between the copying machine and the paper container.
Figure 27:
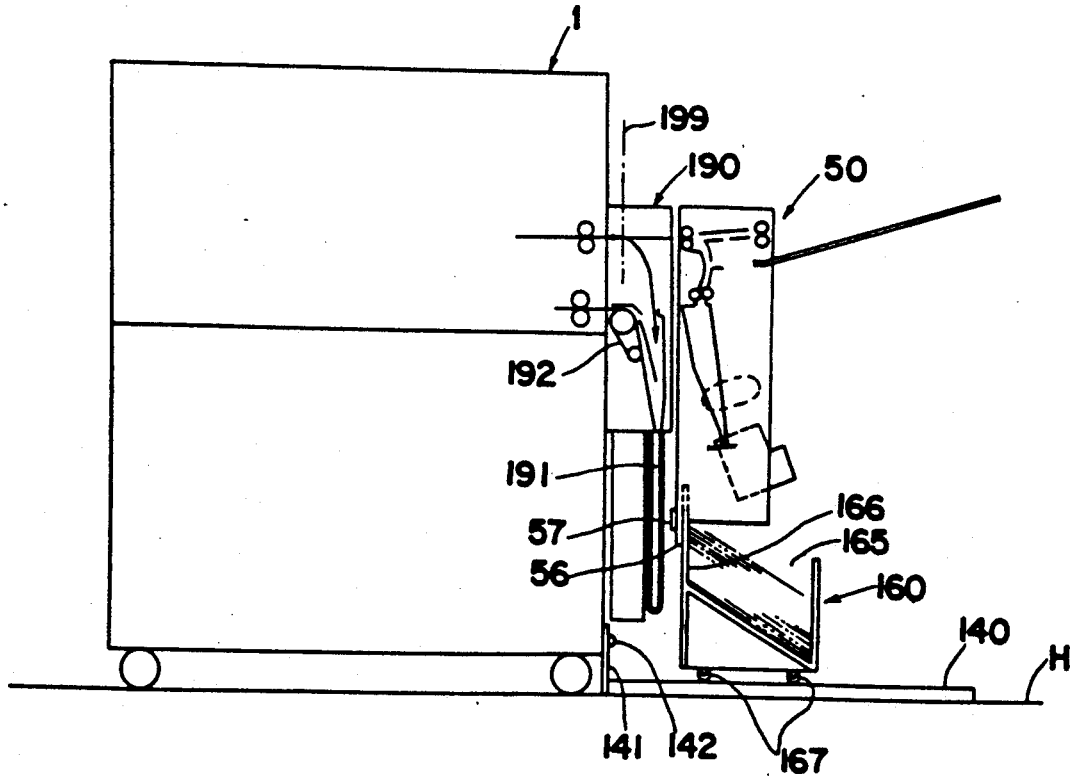
FIG. 27 is an explanatory drawing where a paper refeeding unit is incorporated between the copying machine and the paper container.

Next, the other mechanisms to attach the finisher unit 50 and the stack unit 160 to the copying machine 1 is hereinunder described by referring to FIGS. 26 and 27.

FIG. 26 illustrate one embodiment, wherein a sorter 180 is connected to the copying machine 1, whereby a finisher unit 50 and base plate 140 are mounted onto the sorter 180 which is connected with a stack unit 160. The sorter 180 is disposed on a board 185 via a movable board 186 and can move in the arrow (G) direction. A fixture 182 of bins 181 is rotatable on the pivot 189 which is located toward the copying machine 1 and indicated by the dashed line. A reinforcing plate 183 on the sorter 180 has an opening 184 which prevents the interference by the array of bins 181 when the array of bins 181 is rotatively moved. The finisher unit 50 is hinged in the rear of the reinforcing plate 183 of the sorter 180, and the base plate 140 is connected to the board 185 in a manner identical with that of the previously mentioned embodiment, thereby the positional relation between the base plate 140 and the board 185 is vertically adjustable.

In this embodiment, the sorter 180 distributes copying papers ejected from the copying machine 1 to each bin 181. In the non-sort-mode, copying papers are ejected onto an unshown non-sort tray disposed on a bridge 187. When the papers are stapled, the copying papers are transported to the finisher unit 50 via the bridge 187.

With the above-mentioned constitution, when the array of bins 181 is rotated to open up the transport path of the sorter 180, the finisher unit 50 is at first turned on the above-mentioned pin 55*a* which serves as a pivot. Simultaneously, the stack unit 160 combinedly rotates. Then, the array of bins 181 together with the fixture 182 are rotated. In this course, the array of bins 181 does not cause interference, since the stack unit 160 rotates together with the finisher unit 50.

FIG. 27 illustrates one embodiment, where a paper re-feeding unit 190 is attached to the copying machine 1, and the paper re-feeding unit 190 supports a finisher unit 50 in a manner identical with the above embodiment, and a base plate 140 is connected to the copying machine 1 in a manner identical with the above embodiment.

The paper re-feeding unit 190 can rotate on a pivot 199 located toward the copying machine 1 and indicated by the dashed line. The copying papers ejected from the copying machine 1 are temporarily transported into a vertically disposed path 191, from which re-feeds the copying papers are re-fed to the copying machine 1. When the stapling operation is performed, the copying papers are directly transported to the finisher unit 50.

With the above constitution, when the paper re-feeding unit 190 is rotated to open up the re-feeding path, the finisher unit 50 is first rotated on the pin 55*a* (unshown, in FIG. 27). At the same time, the stack unit 160 rotates, then the paper re-feeding unit 190 is rotated. In this course, the stack unit 160 does not interfere with the vertical path 191, since the stack unit 160 moves together with the finisher unit 50.

Although the present invention has been described in connection with the preferred embodiment thereof, it is to be noted that various changes and modifications are apparent to those skilled in the art. Such changes and modifications are to be understood as included within the scope of the present invention as defined by the appended claims, unless they depart therefrom.

What is claimed is:

1. A paper container for storing copying papers ejected from an image forming device, said paper container comprising:

a copying paper containing tray having a reference member, said reference member defining a reference point of paper alignment, said reference member located at a corner of said tray;

first means for transporting the copying paper to said tray, said first transporting means applying a first paper transporting force to the copying paper; and second means for transporting the copying paper to said reference member, said second transporting means applying a second paper transporting force to the copying paper before a trailing edge of the copying paper leaves said first transporting means, said second transporting means being disposed so that the distance between the second transporting means and the reference member with respect to the transporting direction of the second transporting means is shorter than the length of a minimum copying paper used in the paper container.

2. A paper container as claimed in claim 1, further comprising means for stapling the copying papers stored on said tray.

3. A paper container as claimed in claim 1, wherein the distance between the first transporting means and the second transporting means with respect to the transport direction of the first transporting means is shorter than the length of a minimum copying paper used in the paper container.

4. A paper container as claimed in claim 1, wherein said first transporting means applies the first paper transporting force to the copying paper in a first direction and said second transporting means applies the second paper transporting force to the copying paper in a second direction, wherein said first direction is different from said second direction.

5. A paper container for storing copying papers ejected from an image forming device, said paper container comprising:

a copying paper containing tray having a reference member, said reference member defining a reference point of paper alignment, said reference member located at a corner of said tray;

first means for transporting the copying paper to said tray, said first transporting means applying a first paper transporting force to the copying paper; and second means for transporting the copying paper to said reference member, said second transporting means applying a second paper transporting force to the copying paper before a trailing edge of the copying paper leaves said first transporting means, said second paper transporting force of said second transporting means is smaller than said first paper transporting force of said first transporting means.

6. A paper container as claimed in claim 5, wherein a paper transporting speed of said second transporting means is faster than a paper transporting speed of said first transporting means.

7. A paper container for storing copying papers ejected from an image forming device, said paper container comprising:

a paper containing chamber including a first support member, a second support member, and a reference member, said reference member located at a corner of said chamber, said reference member defining a reference point of paper alignment;

first means for transporting the copying paper to said paper containing chamber, said first transporting means being disposed on an upstream side of a paper transporting direction of said paper containing chamber, said first transporting means applying a force to the copying paper in the paper transporting direction;

means for stapling the copying papers stored in said paper containing chamber, said stapling means being disposed on a downstream side of the paper transporting direction of said paper containing chamber;

second means for transporting the copying paper to said reference member immediately after the trailing edge of the copying paper leaves said first transporting means, said second transporting means being located between the first transporting means and the stapling means and said second transporting means applying a force to said copying paper for moving said copying paper in the paper transport direction and in a direction perpendicular to the paper transport direction; and a distance between said first support member and said second support member being greater between the first transporting means and the second transporting means than the distance between the first support member and the second support member in the area between the second transporting means and the stapling means.

8. A paper container for storing copying papers ejected from an image forming device, said paper container comprising:

a copying paper containing tray having a reference member, said reference member defining a reference point of paper alignment, said reference member located at a corner of said tray;

first means for transporting the copying paper to said tray;

second means for transporting the copying paper to said reference member, said second transporting means applying a force to the copying paper before the trailing edge of the copying paper exits said first transporting means;

means for stapling the copying papers stored on said tray;

means for stacking the copying papers stapled by said stapling means;

wherein said second transporting means also serves to transport the copying papers stapled by said stapling means to said stacking means.

9. A paper container as claimed in claim 8, wherein said second transporting means is a paddled wheel actuated in one of the forward and reverse directions.

10. A paper container as claimed in claim 8, wherein the distance between the first transporting means and the second transporting means with respect to the transport direction of the first transporting means is shorter than the length of the minimum copying paper used in the paper container.

11. A paper container for storing copying papers ejected from an image forming device, said paper container comprising:

a tray for storing the copying papers in a substantially vertical orientation;

means for transporting the copying paper to said tray; and a flexible member extending from an upstream side of said transporting means, adjacent the transporting means, and to an upper portion of the copying papers stored in said tray.

12. A paper container as claimed in claim 11, wherein the transporting means includes a pair of rollers, and said flexible member is arranged so as to contact the copying paper both upstream and downstream of said pair of rollers.

13. A paper container for stapling and storing copying papers ejected from an image forming device, said paper container comprising:

a first unit selectively detachable rom the image forming device, said first unit including a tray for storing the copying papers, means for aligning the copying papers stored in said tray and means for stapling the copying papers aligned in said tray; and a second unit secured to the image forming device independently of said first unit and adapted to stack the copying papers stapled by said stapling means.

14. A paper container for stapling and storing copying papers ejected from an image forming device, said paper container comprising:

a first unit detachably disposed in a position opposing a paper ejection portion of the image forming device, said first unit including a tray for storing the copying papers, means for aligning the copying papers stored in said tray and means for stapling the copying papers aligned in said tray; and a second unit for stacking the copying papers stapled by said stapling means, said second unit being connected to the first unit independently of the image forming device, said second unit being adjustable in the vertical direction with respect to said first unit.

15. A paper container as claimed in claim 14, wherein said first and second units are detached from the image forming device as one entity.

16. A paper container for storing copying papers ejected from an image forming device, said paper container comprising:

a tray for storing the copying papers in a substantially vertical orientation;

a pair of rollers for transporting the copying paper to said tray, said rollers located at an upper portion of the tray; and a flexible member for guiding the copying paper, said flexible member extending from the upstream side of the rollers, adjacent said rollers, and to the downstream side of the rollers in a transparent direction.

17. A paper container for storing copying papers ejected from an image forming device, said paper container comprising:

a tray for storing the copying papers in a substantially vertical orientation;

a pair of rollers for transporting the copying paper to said tray, said rollers located at an upper portion of the tray; and a flexible member for guiding the copying paper, said flexible member extending from the upstream side of the rollers, adjacent said rollers, and to the downstream side of the rollers in a transport direction;

wherein a bottom end of said flexible member extends to a position slightly lower than that of an upper edge of the copying paper stored in the tray.

* * * * *

UNITED STATES PATENT AND TRADEMARK OFFICE

CERTIFICATE OF CORRECTION

PATENT NO. : 5,013,021

DATED : May 7, 1991

INVENTOR(S) : Akiyoshi JOHDAI, et al.

It is certified that error appears in the above-identified patent and that said Letters Patent is hereby corrected as shown below:

In Column 20, line 43, "rom" is changed to --from--.

Signed and Sealed this

Twenty-ninth Day of December, 1992

*Attest:*

DOUGLAS B. COMER

*Attesting Officer*

*Acting Commissioner of Patents and Trademarks*